US007852188B2

(12) United States Patent
Lai

(10) Patent No.: US 7,852,188 B2
(45) Date of Patent: Dec. 14, 2010

(54) TRANSFORMER

(75) Inventor: Ting-Cheng Lai, Taichung (TW)

(73) Assignee: Greatchip Technology Co., Ltd., Taichung (TW)

( * ) Notice: Subject to any disclaimer, the term of this patent is extended or adjusted under 35 U.S.C. 154(b) by 0 days.

(21) Appl. No.: 12/554,157

(22) Filed: Sep. 4, 2009

(65) Prior Publication Data

US 2010/0060399 A1 Mar. 11, 2010

(30) Foreign Application Priority Data

Sep. 8, 2008 (TW) ..... 97134387 A
Dec. 29, 2008 (TW) ..... 97151205 A

(51) Int. Cl.
*H01F 17/06* (2006.01)
*H01F 27/28* (2006.01)
*H01F 27/24* (2006.01)
*H01F 27/30* (2006.01)

(52) U.S. Cl. ..... 336/212; 336/208; 336/178

(58) Field of Classification Search ..... 336/212, 336/222, 220, 198, 208, 178, 214
See application file for complete search history.

(56) References Cited

U.S. PATENT DOCUMENTS 4,885,445 A * 12/1989 Taniguchi ..... 219/760
5,053,738 A * 10/1991 Sato et al. ..... 336/165
6,424,247 B2 7/2002 Suzuki
6,753,752 B1 * 6/2004 Lin ..... 336/212
7,598,839 B1 * 10/2009 Wedley ..... 336/212
7,612,640 B2 * 11/2009 Sano ..... 336/83

* cited by examiner

*Primary Examiner*—Anh T Mai
(74) *Attorney, Agent, or Firm*—Fox Rothschild, LLP; Robert J. Sacco

(57) ABSTRACT

A transformer includes primary and secondary windings coupled electromagnetically to each other and wounded respectively around primary and secondary winding portions of a bobbin unit, and a core unit mounted to the bobbin unit and including first and second core parts that form a magnetic circuit path. The first core part includes insertion and extension segments extending from a connecting segment. The second core part includes insertion and extension segments, and an adjusting segment extending from a connecting segment toward the first core part. The extension segments of the first and second core parts contact each other. The insertion segments of the first and second core parts extend respectively through the primary and secondary winding portions to contact each other.

17 Claims, 23 Drawing Sheets

TRANSFORMER

CROSS-REFERENCE TO RELATED APPLICATION

This application claims priority of Taiwanese Application Nos. 097134387 and 097151205, filed on Sep. 8, 2008 and Dec. 29, 2008, respectively.

BACKGROUND OF THE INVENTION

1. Field of the Invention

The invention relates to a transformer, more particularly to a transformer capable of adjusting leakage magnetic flux.

2. Description of the Related Art

FIG. 1 illustrates a conventional transformer 1 disclosed in U.S. Pat. No. 6,424,247. The conventional transformer 1 includes two primary windings 12 wound respectively around two bar-shaped magnetic cores 13, and electromagnetically coupled to a primary winding 11 that is electromagnetically coupled to the magnetic cores 13.

After assembly of the magnetic cores 13 and the primary winding 11 and the secondary windings 12, leakage magnetic flux of the conventional transformer is decided. However, since the magnetic cores 13 are made of magnetic powder through sintering, an error in the size of each magnetic core 13 may occur due to expansion and contraction during sintering process. As a result, reluctances of the magnetic cores 13 are not identical, thereby resulting in a difference between the secondary windings 12 in power transfer.

SUMMARY OF THE INVENTION

Therefore, the object of the present invention is to provide a transformer that is capable of adjusting leakage magnetic flux during fabrication.

According to one aspect of the present invention, a transformer comprises:

a bobbin unit having a first primary winding portion, and a first secondary winding portion;

a first primary winding wound around the first primary winding portion of the bobbin unit;

a first secondary winding wound around the first secondary winding portion of the bobbin unit, and coupled electromagnetically to the first primary winding; and a core unit mounted to the bobbin unit and including a first core part that includes a connecting segment extending in a longitudinal direction, a first insertion segment extending from the connecting segment of the first core part in a transverse direction perpendicular to the longitudinal direction and through the first primary winding portion of the bobbin unit, and a first extension segment extending from the connecting segment of the first core part in the transverse direction and spaced apart from the first insertion segment of the first core part, and a second core part that forms a magnetic circuit path with the first core part and that includes a connecting segment extending in the longitudinal direction, a first insertion segment extending from the connection segment of the second core part toward the first core part in the transverse direction and through the first secondary winding portion of the bobbin unit, and disposed in contact with the first insertion segment of the first core part, a first extension segment extending from the connection segment of the second core part toward the first core part in the transverse direction, spaced apart from the first insertion segment of the second core part, and disposed in contact with the first extension segment of the first core part, and a first adjusting segment extending from the connecting segment of the second core part toward the first core part in the transverse direction.

According to another aspect of the present invention, a transformer comprises:

a bobbin unit including a primary winding portion, two secondary winding portions, and a casing for mounting the primary winding portion and the secondary winding portions therein;

a primary winding wound around the primary winding portion of the bobbin unit;

two secondary windings wound respectively around the secondary winding portions of the bobbin unit, and coupled electromagnetically to the primary winding; and a core unit mounted to the bobbin unit, and including a first core part that includes a connecting segment that extends in a longitudinal direction, two extension segments opposite to each other in the longitudinal direction, and extending from the connecting segment of the first core part in a transverse direction that is perpendicular to the longitudinal direction into the casing, and an insertion segment disposed spacedly between the extension segments of the first core part, and extending from the connecting segment in the transverse direction through the primary winding portion of the bobbin unit, and a second core part that forms a magnetic circuit path with the first core part and that includes a connecting segment extending in the longitudinal direction, two extension segments opposite to each other in the longitudinal direction, and extending from the connecting segment of the second core part in the transverse direction into the casing such that the extension segments of the second core part contact respectively the extension segments of the first core part, and two insertion segments disposed spacedly between the extension segments of the second core part, and extending respectively from the connecting segment of the second core part in the transverse direction through the secondary winding portions of the bobbin unit such that the insertion segments of the second core part contact respectively the insertion segments of the first core part.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
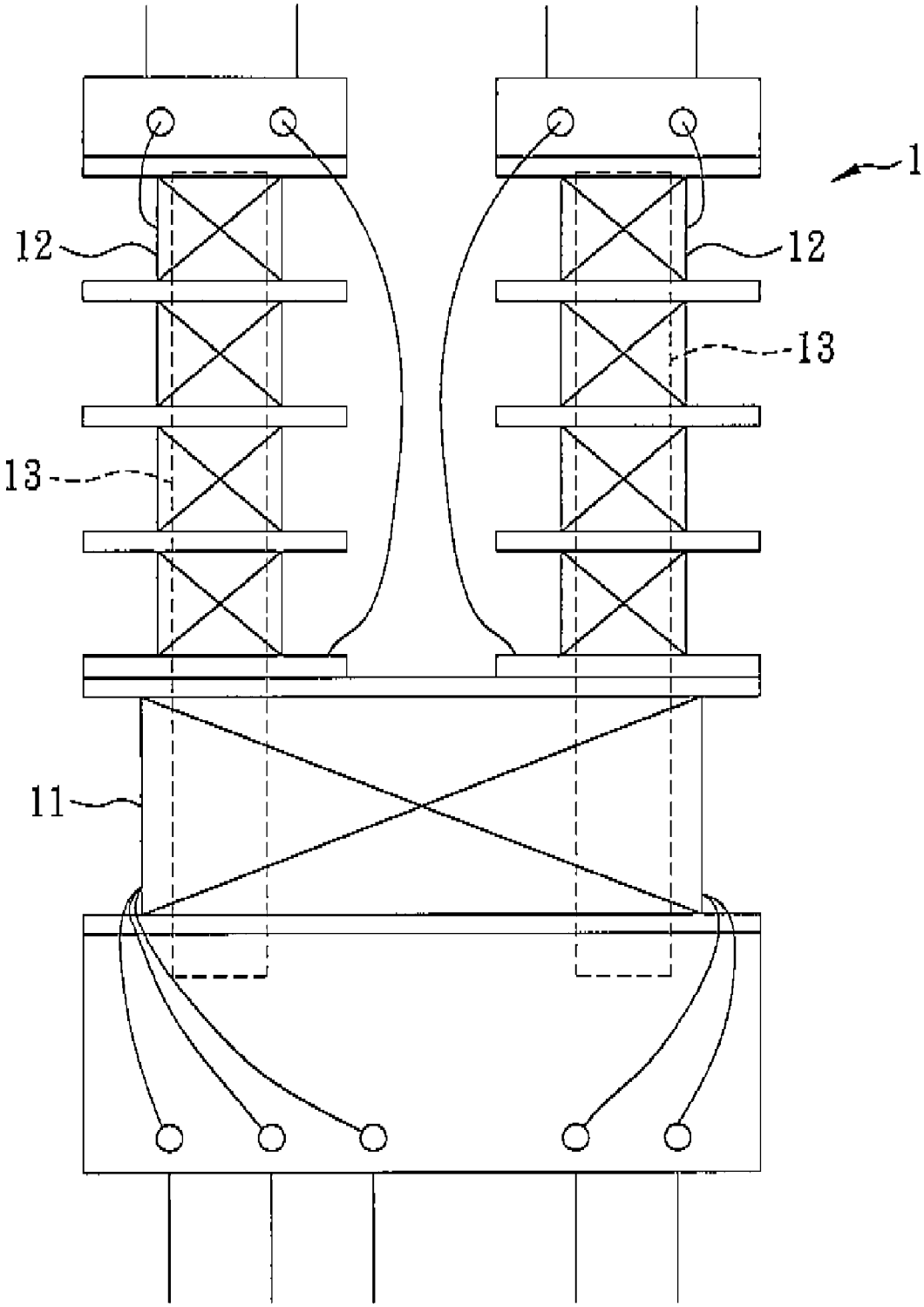
FIG. 1 PRIOR ART
FIG. 1 is a schematic top view of a conventional transformer.

Before the present invention is described in greater detail, it should be noted that like elements are denoted by the same reference numerals throughout the disclosure.

Figure 2:
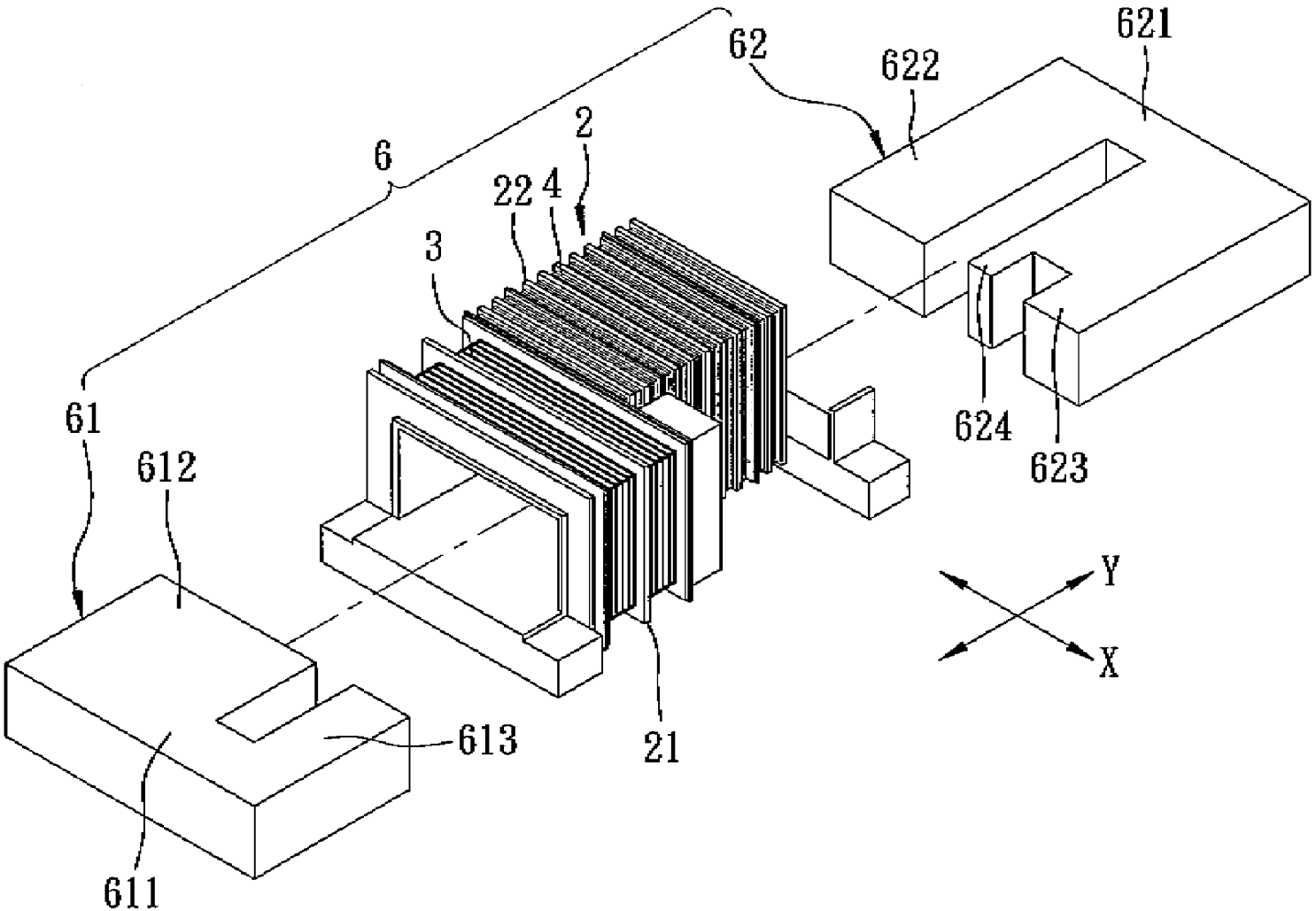
FIG. 2 is an exploded perspective view showing the first preferred embodiment of a transformer according to the present invention.
Figure 3:
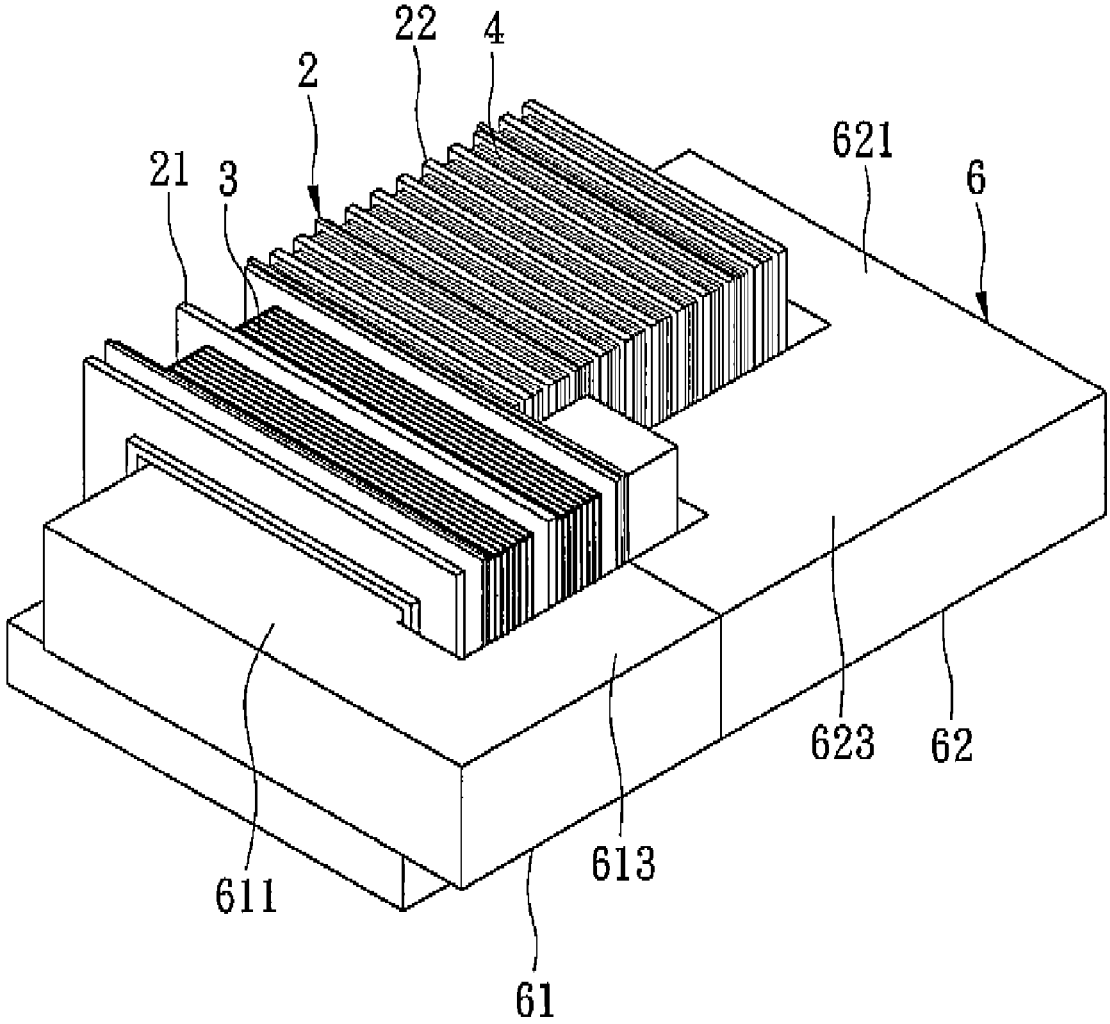
FIG. 3 is an assembled perspective view showing the first preferred embodiment.

Referring to FIGS. 2 and 3, the first preferred embodiment of a transformer according to the present invention is shown to include a bobbin unit 2, a first primary winding 3, a first secondary winding 4, and a core unit 6.

The bobbin unit 2 includes a first primary winding portion 21 and a first secondary winding portion 22 in this embodiment.

The first primary winding 3 is wound around the first primary winding portion 21 of the bobbin unit 2.

The first secondary winding 4 is wound around the first secondary winding portion 22 of the bobbin unit 2, and is coupled electromagnetically to the first primary winding 3.

Figure 4:
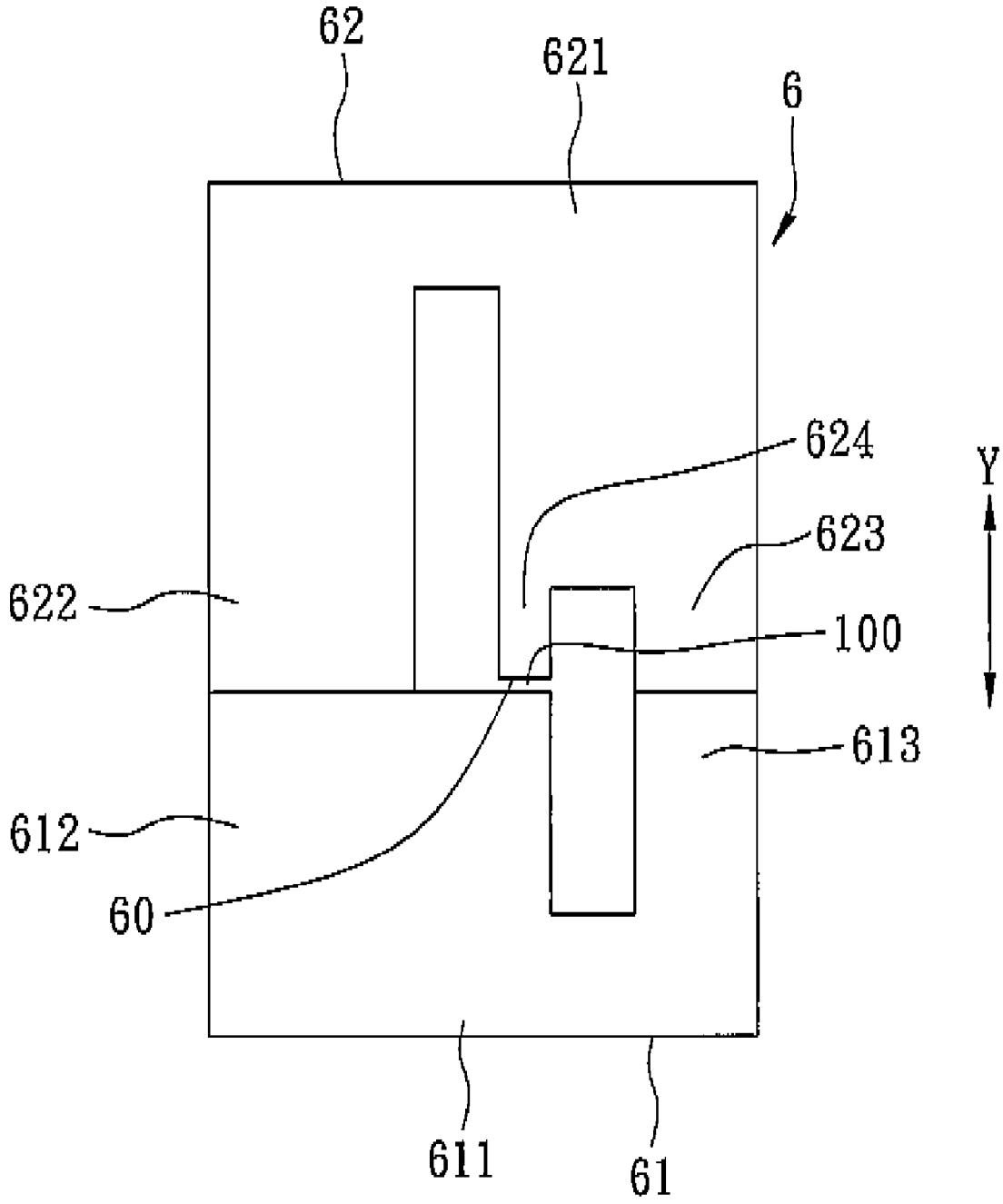
FIG. 4 is a schematic view showing a core unit of the first preferred embodiment.

Referring further to FIG. 4, the core unit 6 is mounted to the bobbin unit 2 and includes a first core part 61, and a second core part 62 that forms a magnetic circuit path with the first core part 61.

In this embodiment, the first core part 61 includes a connecting segment 611, a first insertion segment 612 and a first extension segment 613. The connecting segment 611 extends in a longitudinal direction (X). The first insertion segment 612 extends from the connecting segment 611 in a transverse direction (Y) perpendicular to the longitudinal direction (X) and through the first primary winding portion 21 of the bobbin unit 2. The first extension segment 613 extends from the connecting segment 611 in the transverse direction (Y), and is spaced apart from the first insertion segment 612.

In this embodiment, the second core part 62 includes a connecting segment 621, a first insertion segment 622, a first extension segment 623, and a first adjusting segment 624. The connecting segment 621 extends in the longitudinal direction (X) The first insertion segment 622 extends from the connecting segment 621 toward the first core part 61 in the transverse direction (Y) and through the first secondary winding portion 22 of the bobbin unit 2, and is disposed in contact with the first insertion segment 612 of the first core part 61. The first extension segment 623 extends from the connecting segment 621 toward the first core part 61 in the transverse direction (Y), is spaced apart from the first insertion segment 622, and is disposed in contact with the first extension segment 613 of the first core part 61. The first adjusting segment 624 extends from the connecting segment 621 toward the first core part 61 in the transverse direction (Y), and is disposed spacedly between the first insertion segment 622 and the first extension segment 623 in this embodiment. The first adjusting segment 624 has an end surface that faces the first core part 61 and that serves as a magnetic leakage area 60.

It is noted that a first air gap 100 is formed between the first insertion segment 612 of the first core part 61 and the first adjusting segment 624 of the second core part 62, as shown in FIG. 4. Therefore, during fabrication, the width of the first air gap 100 in the transverse direction (Y) can be adjusted by varying the length of the first adjusting segment 624 so as to control magnetic leakage from the magnetic circuit path, i.e., adjust a leakage coefficient, thereby attaining impedance match. Thus, the transformer can attain maximum power transfer.

Figure 5:
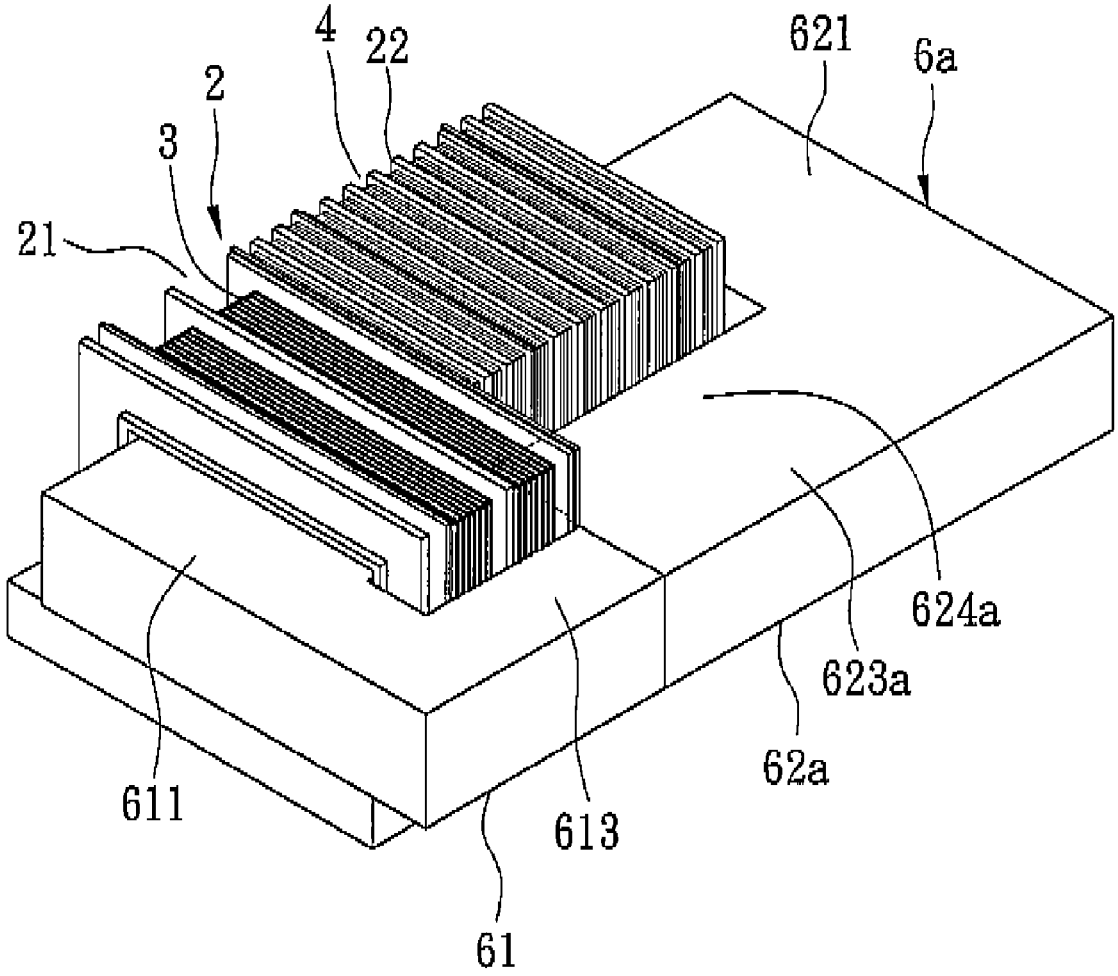
FIG. 5 is a perspective view showing the second preferred embodiment of a transformer according to the present invention.
Figure 6:
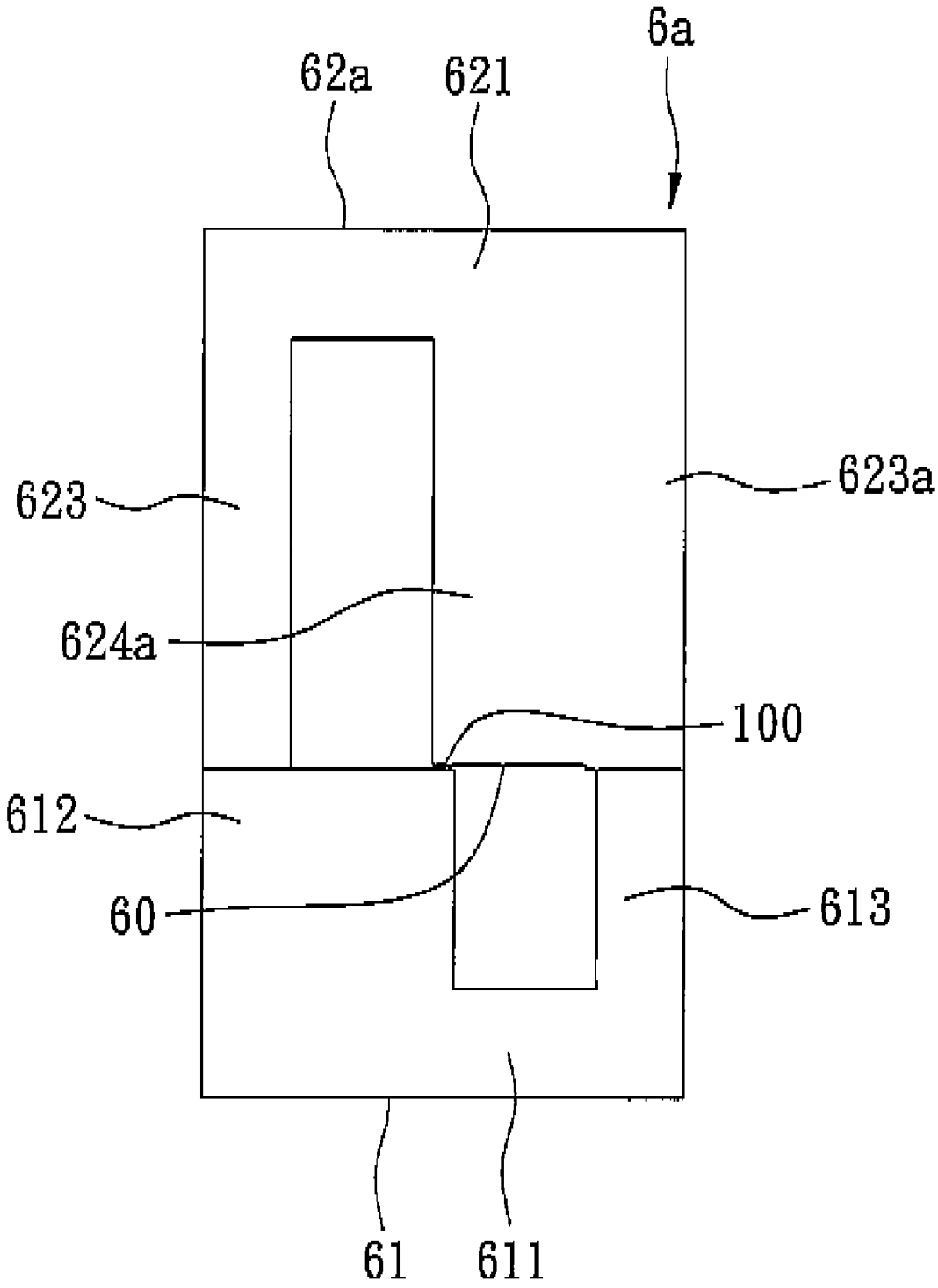
FIG. 6 is a schematic view of a core unit of the second preferred embodiment.

FIGS. 5 and 6 illustrate the second preferred embodiment of a transformer according to this invention, which is a modification of the first preferred embodiment. In this embodiment, for the second core part (62*a*), the first adjusting segment (624*a*) is integrally connected to the first extension segment (623*a*). During fabrication, the first air gap 100 is formed by grinding the first adjusting segment (624*a*) such that the magnetic leakage area 60 is formed.

FIGS. 7 to 10 illustrate the third preferred embodiment of a transformer according to this invention, which is a modification of the first preferred embodiment. In this embodiment, the transformer further includes a second secondary winding 4' coupled electromagnetically to the first primary winding 3.

Figure 8:
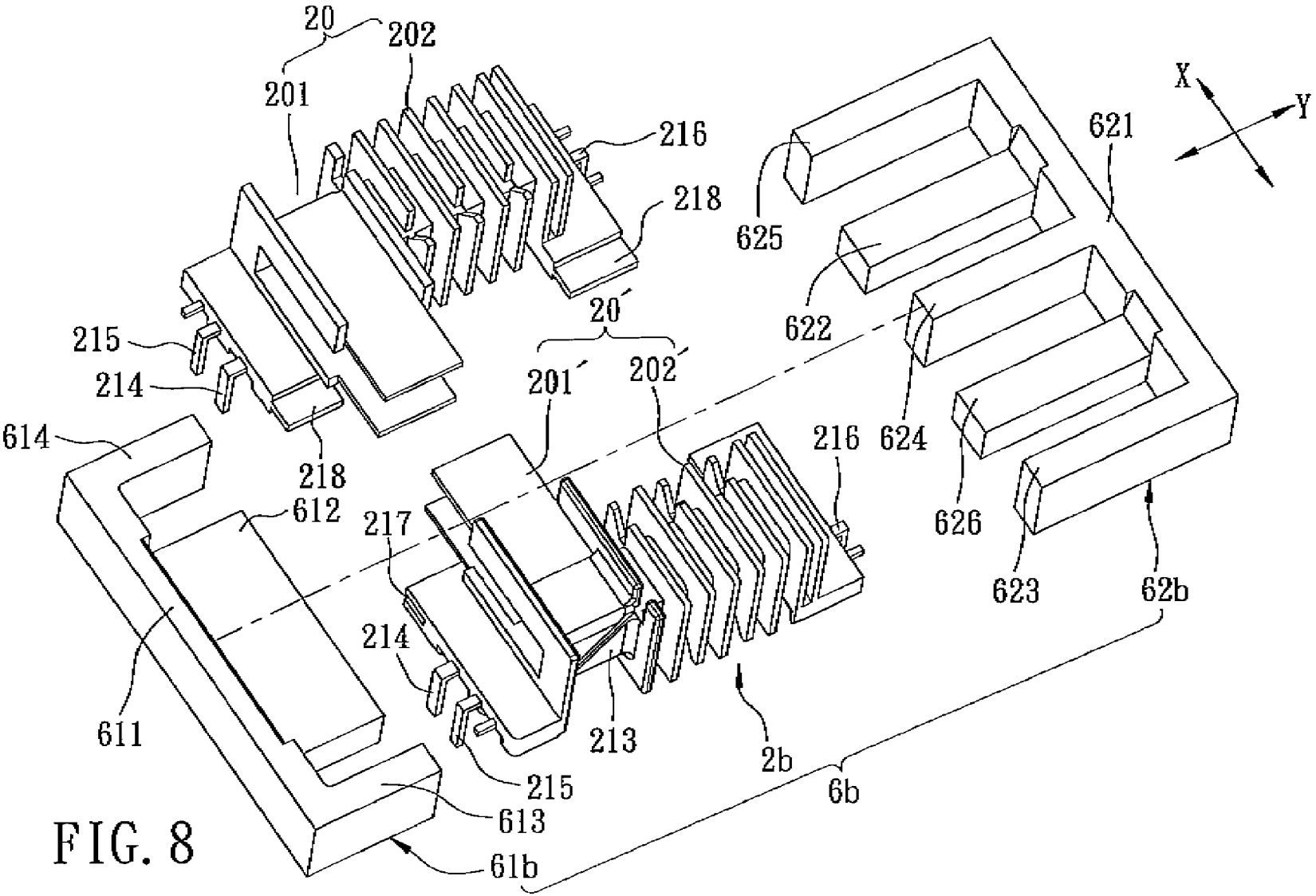
FIG. 8 is an exploded perspective view showing the third preferred embodiment, where the primary winding, and first and second secondary windings are omitted for the sake of simplicity.

The bobbin unit (2*b*) further has a second secondary winding portion 22' opposite to the first secondary winding portion 22 in the longitudinal direction (X) for winding the second secondary winding 4' there around. In this embodiment, the bobbin unit (2*b*) includes a first bobbin 20, and a second bobbin 20' connected to the first bobbin 20. The first bobbin 20 has first and second winding end portions 201, 202 opposite to each other in the transverse direction (Y). The second winding end portion 202 serves as the first secondary winding portion 22. The second bobbin 20' has first and second winding end portions 201', 202' opposite to each other in the transverse direction (Y). The second winding end portion 202' of the second bobbin 20' is connected to the second winding end portion 202 of the first bobbin 20, and serves as the second secondary winding portion 22'. The first winding end portions 201, 201' of the first and second bobbins 20, 20' are complementary and connected to each other, and constitute the first primary winding portion 21. Each of the first and second bobbins 20, 20' further has first and second pins 214, 215 extending from the first winding end portion 201, 201' thereof, and a third pin 216 extending from the second winding end portion 202, 202' thereof. In this embodiment, as shown in FIG. 8, each of the first and second winding end portions 201, 202 of the first bobbin 20 has an engaging flange 218. Each of the first and second winding end portions 201', 2 02' of the second bobbin 20' is formed with an engaging groove 217 that engages the engaging flange 218 of a corresponding one of the first and second winding end portions 201, 202 of the first bobbin 20.

The first primary winding 3 is formed through continuous winding of a winding wire that has opposite end portions coupled respectively to the first pins 214 of the first and second bobbins 20, 20'.

The first secondary winding 4 is formed through continuous winding of a winding wire that has opposite end portions, one of which extends along the first winding end portion 201 of the first bobbin 20, and is coupled to the second pin 215 of the first bobbin 20, and the other one of which is coupled to the third pin 216 of the first bobbin 20.

The second secondary winding 4' is formed through continuous winding of a winding wire that has opposite end portions, one of which extends along the first winding end portion 201' of the second bobbin 20', and is coupled to the second pin 215 of the second bobbin 20', and the other one of which is coupled to the third pin 216 of the second bobbin 20'.

Furthermore, the first winding end portion 201, 201' of each of the first and second bobbins 20, 20' is formed with a wire-receiving passage 213 for permitting extension of said one of the opposite end portions of the winding wire of a corresponding one of the first and second secondary windings 4, 4' therethrough.

Figure 9:
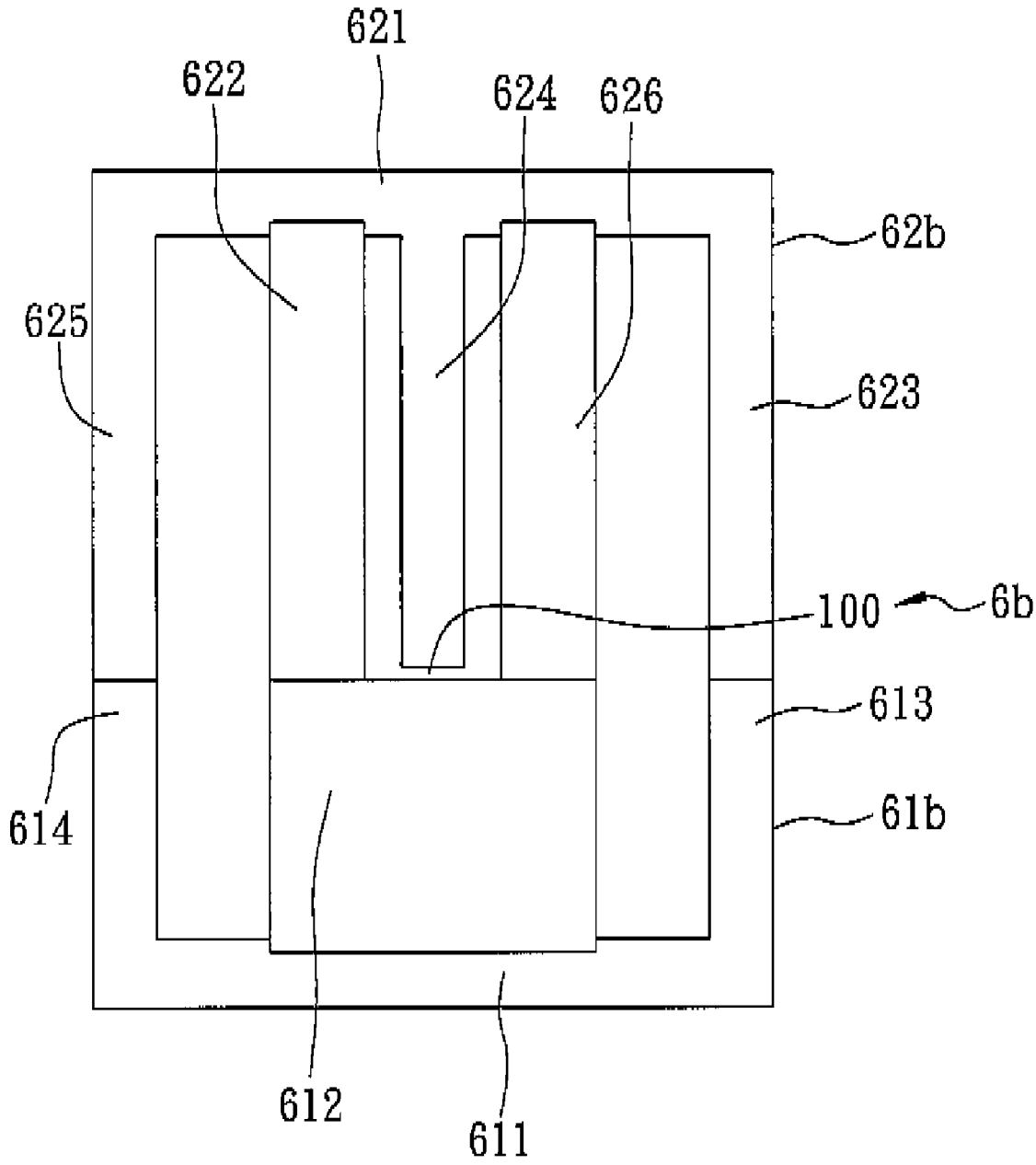
FIG. 9 is a schematic view showing a core unit of the third preferred embodiment.

In this embodiment, referring to FIGS. 8 and 9, the first core part (61*b*) of the core unit (6*b*) further includes a second extension segment 614 extending from the connecting segment 611 in the transverse direction, and opposite to the first extension segment 613 in the longitudinal direction (X) so that the first insertion segment 612 is disposed spacedly between the first and second extension segments 613, 614. The second core part (62*b*) of the core unit (6*b*) further includes a second extension segment 625 and a second insertion segment 626. For the second core part (62*b*) the second extension segment 625 extends from the connecting segment 621 toward the first core part (61*b*) in the transverse direction (Y), is opposite to the first extension segment 623 in the longitudinal direction (X) so that the first insertion segment 622 and the first adjusting segment 624 are disposed spacedly between the first and second extension segments 623, 625, and is disposed in contact with the second extension segment 614 of the first core part (61*b*). The second insertion segment 626 is disposed spacedly between the first extension segment 623 and the first adjusting segment 624, and extends from the connecting segment 621 in the transverse direction (Y) toward the first core part (61*b*) and through the second secondary winding portion 22' of the bobbin unit (2*b*) so as to contact the first insertion segment 612 of the first core part (61*b*).

Figure 7:
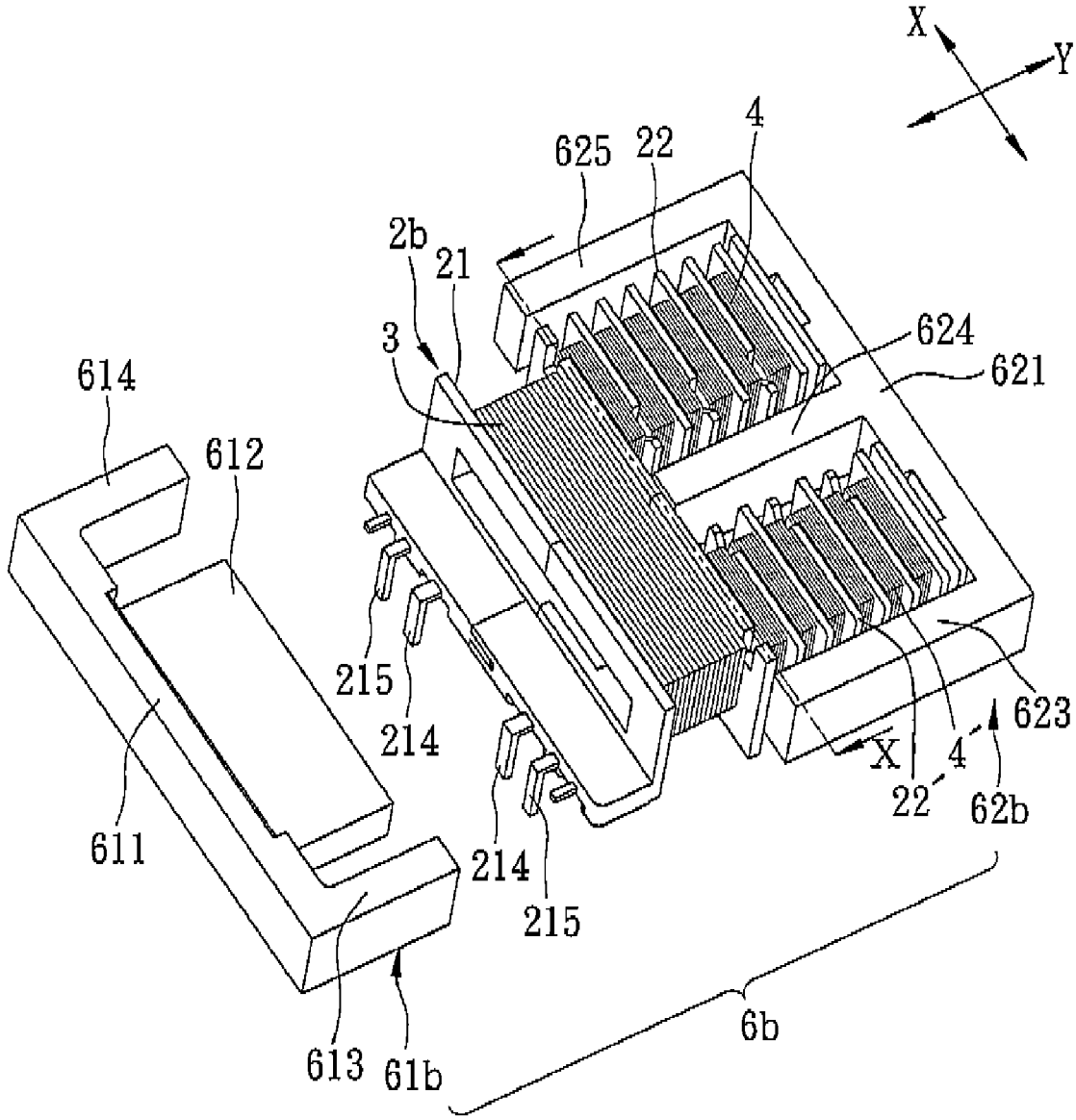
FIG. 7 is a partly exploded perspective view showing the third preferred embodiment of a transformer according to the present invention, where a first primary winding is omitted for the sake of simplicity.
Figure 10:
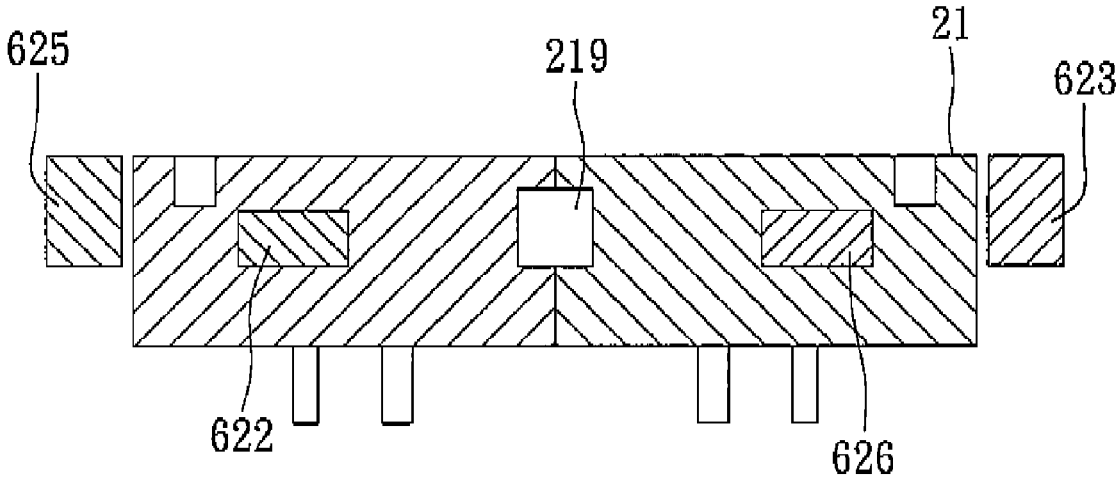
FIG. 10 is a schematic sectional view of FIG. 7 taken along line X-X.

Furthermore, referring to FIGS. 7 and 10, the first primary winding portion 21 of the bobbin unit (2*b*) has a connecting side connected to the first and second secondary winding portions 22, 22', formed with an opening 219 that is disposed between the first and second secondary winding portions 22, 22' and that is registered with the first adjusting segment 624 of the second core part (62*b*), and permitting extension of the first and second insertion segments 622, 626 of the second core part (62*b*) into the first primary winding portion 21 of the bobbin unit (2*b*) therethough. As a result, magnetic field lines are capable of passing through the opening 219.

Figure 11:
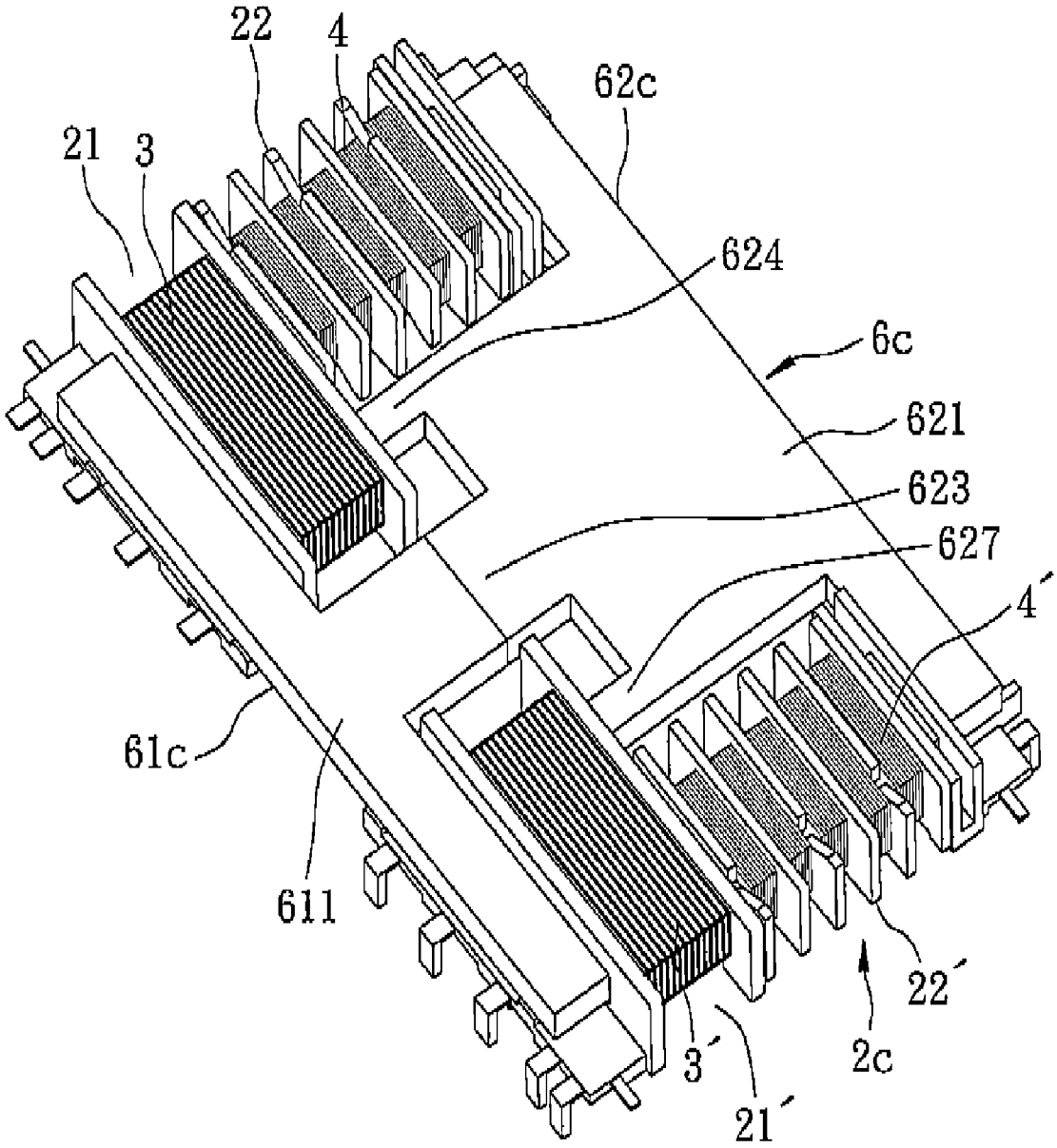
FIG. 11 is a perspective view showing the fourth preferred embodiment of a transformer according to the present invention.
Figure 12:
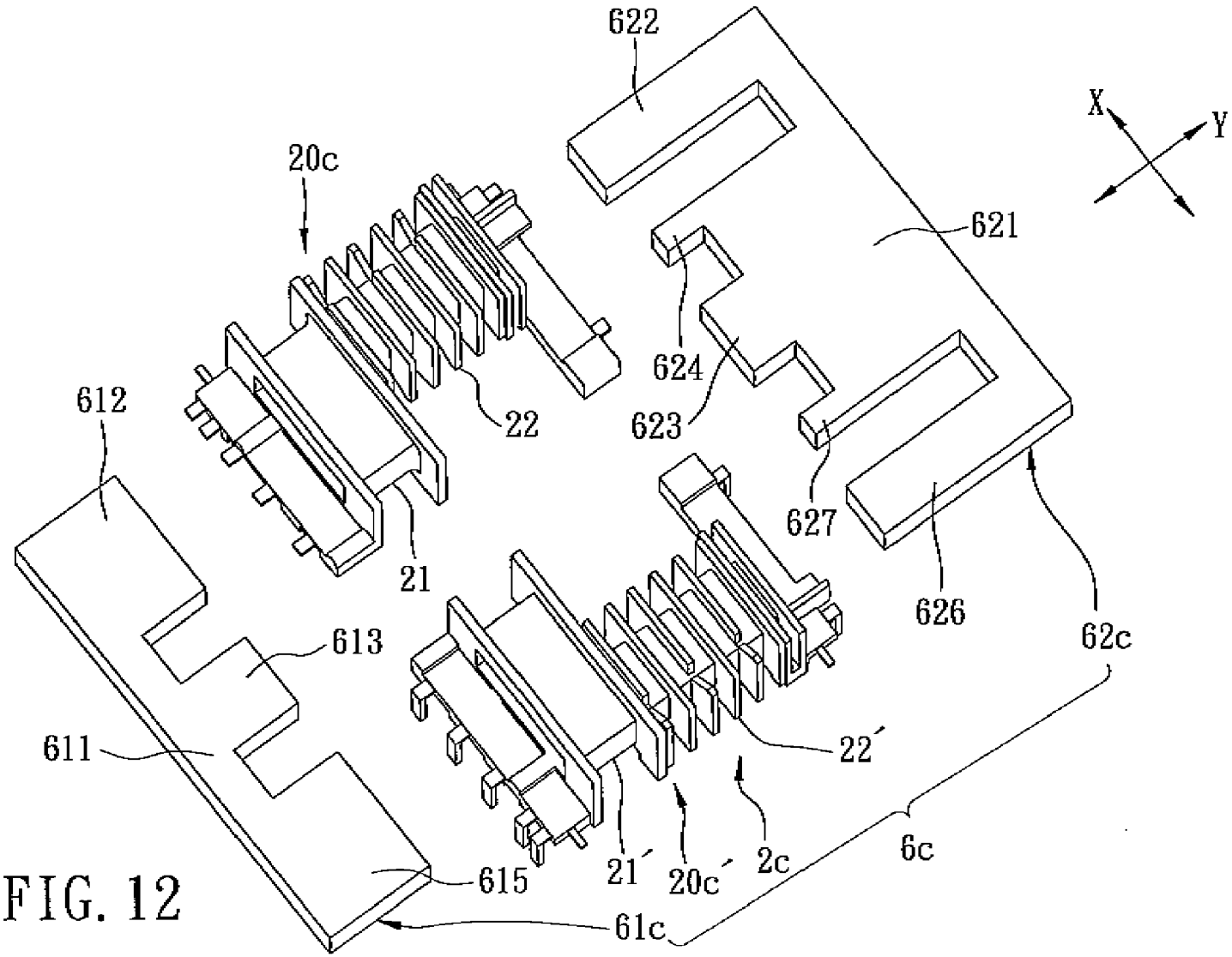
FIG. 12 is an exploded perspective view showing the fourth preferred embodiment, where first and second primary windings, and first and second secondary windings are omitted for the sake of simplicity.
Figure 13:
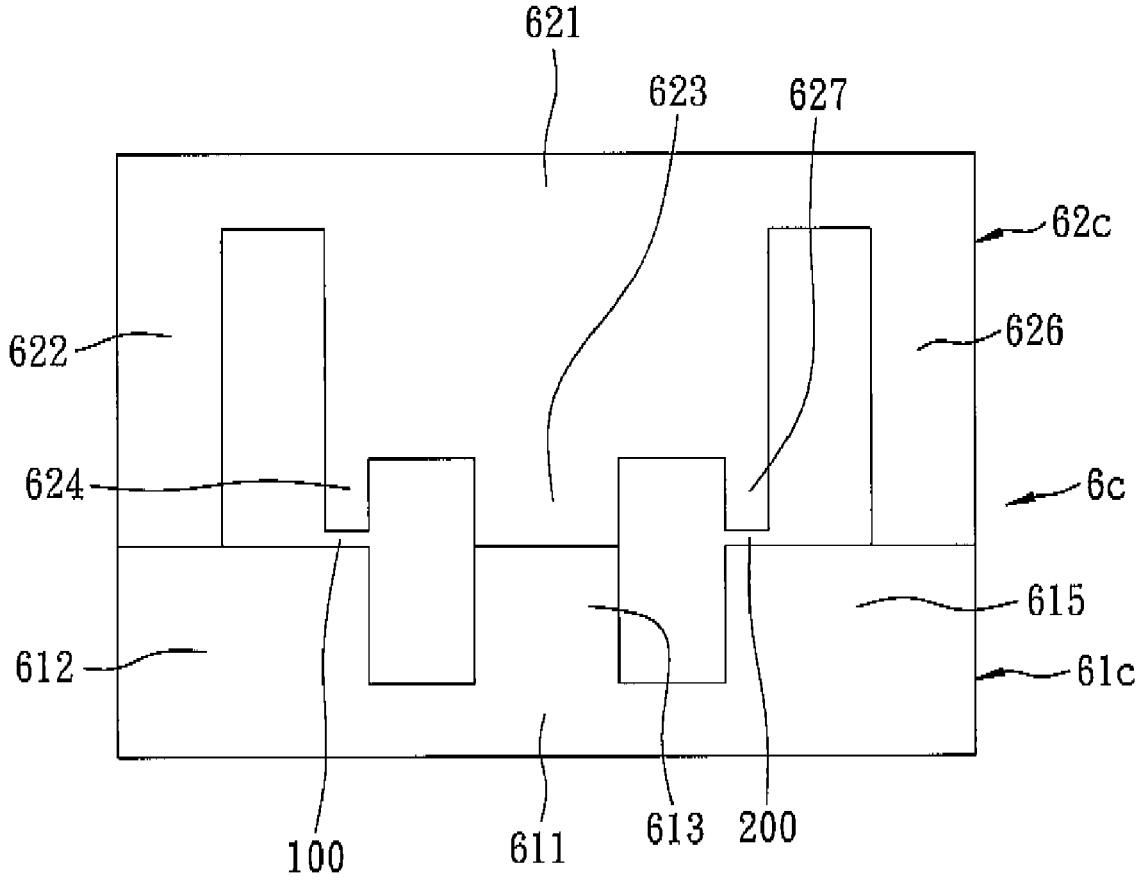
FIG. 13 is a schematic view showing a core unit of the fourth preferred embodiment.

FIGS. 11 to 13 illustrate the fourth preferred embodiment of a transformer according to this invention, which is a modification of the first preferred embodiment. In this embodiment, the transformer further includes a second primary winding 3', and a second secondary winding 4 coupled electromagnetically to the second primary winding 3'.

The bobbin unit (2*c*) includes first and second bobbins (20*c*, 20*c*') opposite to each other in the longitudinal direction (X). Each of the first and second bobbins (20*c*, 20*c*') has first and second winding end portions in the transverse direction (Y). The first and second winding end portions of the first bobbin (20*c*) serve respectively as the first primary winding portion 21 and the first secondary winding portion 22. The first and second winding end portions of the second bobbin (20*c*') serve respectively as a second primary winding portion 21' for winding the second primary winding 3' therearound, and a second secondary winding portion 22' for winding the second secondary winding 4, therearound.

In this embodiment, referring to FIGS. 12 and 13, the first core part (61*c*) of the core unit (6*c*) further includes a second insertion segment 615 extending from the connecting segment 611 in the transverse direction (Y) and through the second primary winding portion 21', and opposite to the first insertion segment 612 in the longitudinal direction (X) so that the first extension segment 613 is disposed spacedly between the first and second insertion segments 612, 615. The second core part (62*c*) of the core unit (6*c*) further includes a second insertion segment 626 and a second adjusting segment 627. For the second core part (62*c*), the second insertion segment 626 extends from the connecting segment 621 in the transverse direction (Y) toward the first core part (61*c*) and through the second primary winding portion 22', is opposite to the first insertion segment 622 in the longitudinal direction (X) so that the first extension segment 623 is disposed spacedly between the first and second insertion segments 622, 626, and is disposed in contact with the second insertion segment 615 of the first core part (61*c*). The second adjusting segment 627 is disposed spacedly between the first extension segment 623 and the second insertion segment 626 in this embodiment, and extends is from the connecting segment 621 in the transverse direction (Y) toward the first core part (61*c*) such that a second air gap 200 is formed between the second insertion segment 615 of the first core part (61*c*) and the second adjusting segment 627.

In such a configuration, during fabrication, the widths of the first and second air gaps 100, 200 in the transverse direction (Y) can be adjusted by varying the lengths of the first and second adjusting segments 624, 627 so as to control magnetic leakage from the magnetic circuit path, i.e., adjust a leakage coefficient, thereby attaining impedance match. Thus, the transformer can attain maximum power transfer.

Figure 14:
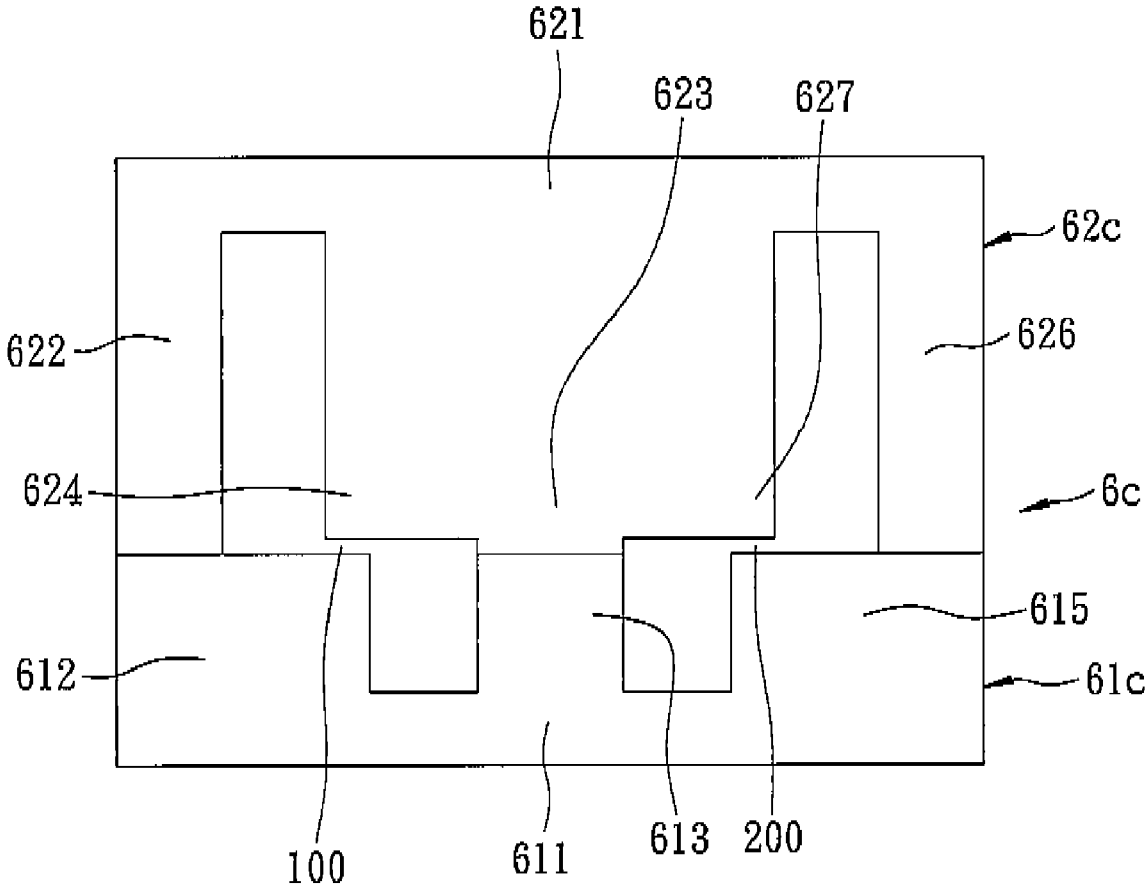
FIG. 14 is a schematic view of a variation of the core unit of the fourth preferred embodiment.

FIG. 14 illustrates a variation of the core unit (6*c*) of the transformer of the fourth preferred embodiment, wherein the first extension segment 623 of the second core part (62*c*) is integrally connected with the first and second adjusting segments 624, 627.

Figure 15:
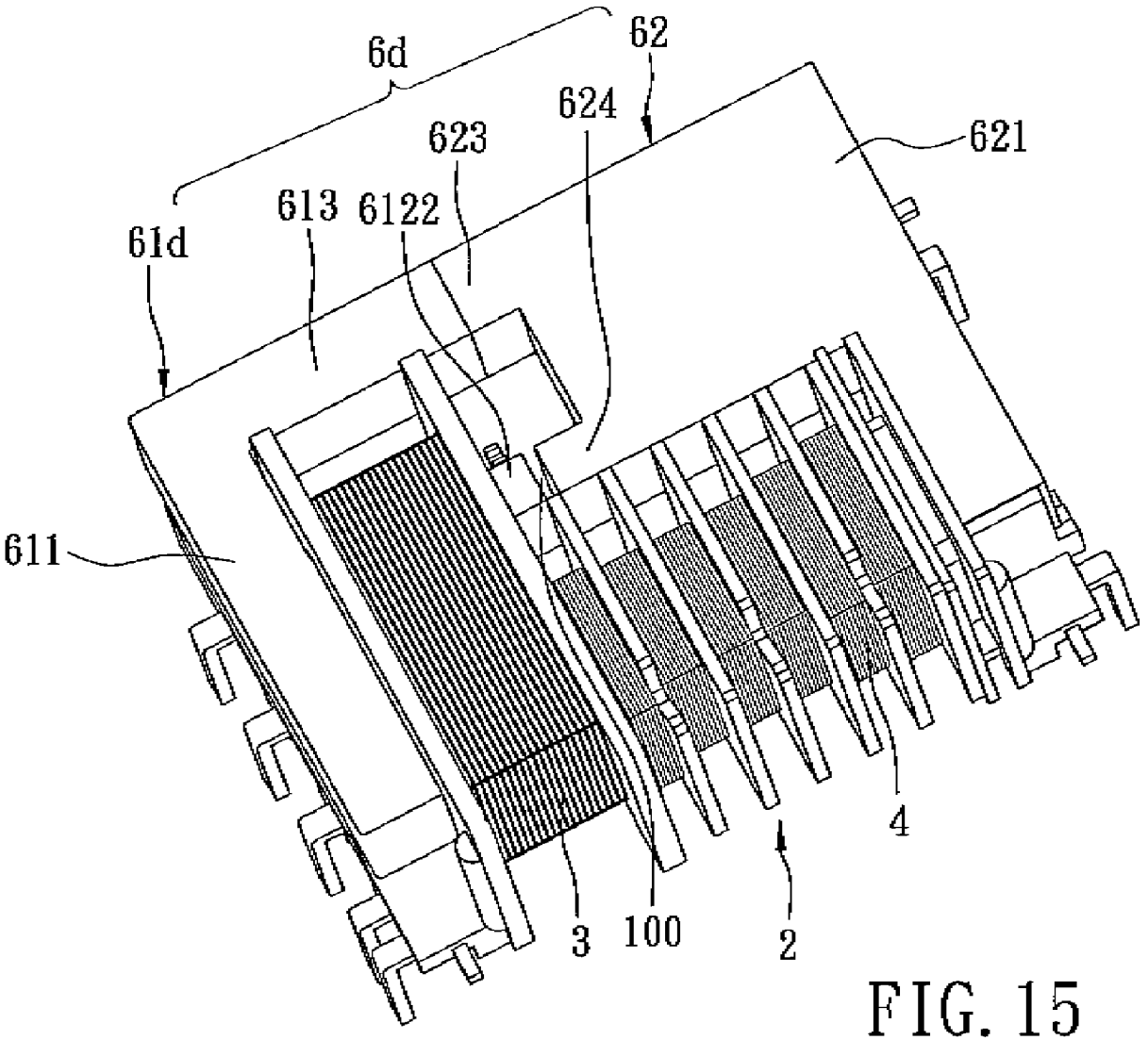
FIG. 15 is a perspective view showing the fifth preferred embodiment of a transformer according to the present invention.
Figure 16:
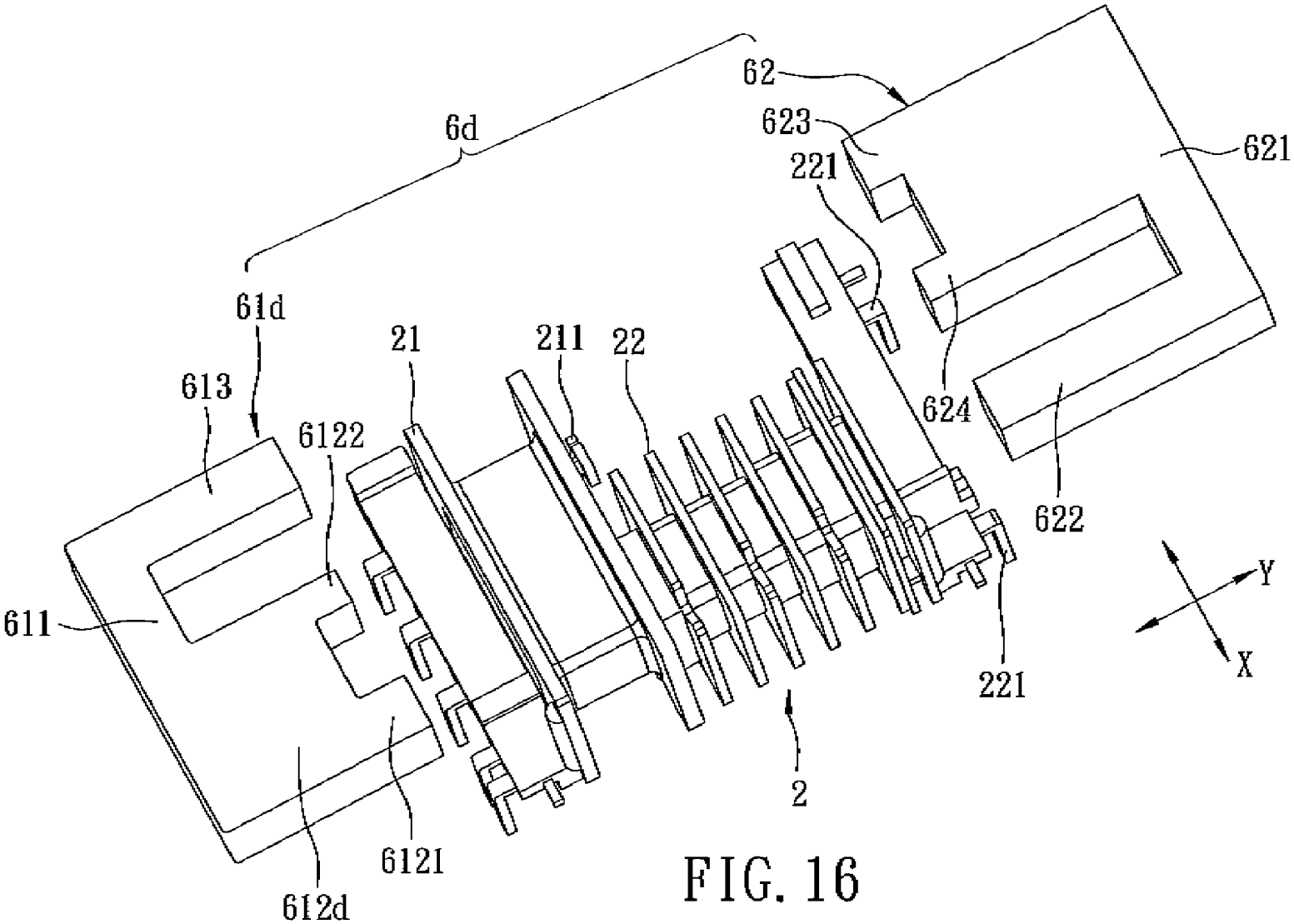
FIG. 16 is an exploded perspective view showing the fifth preferred embodiment, where a first primary winding and a first secondary winding are omitted for the sake of simplicity.
Figure 17:
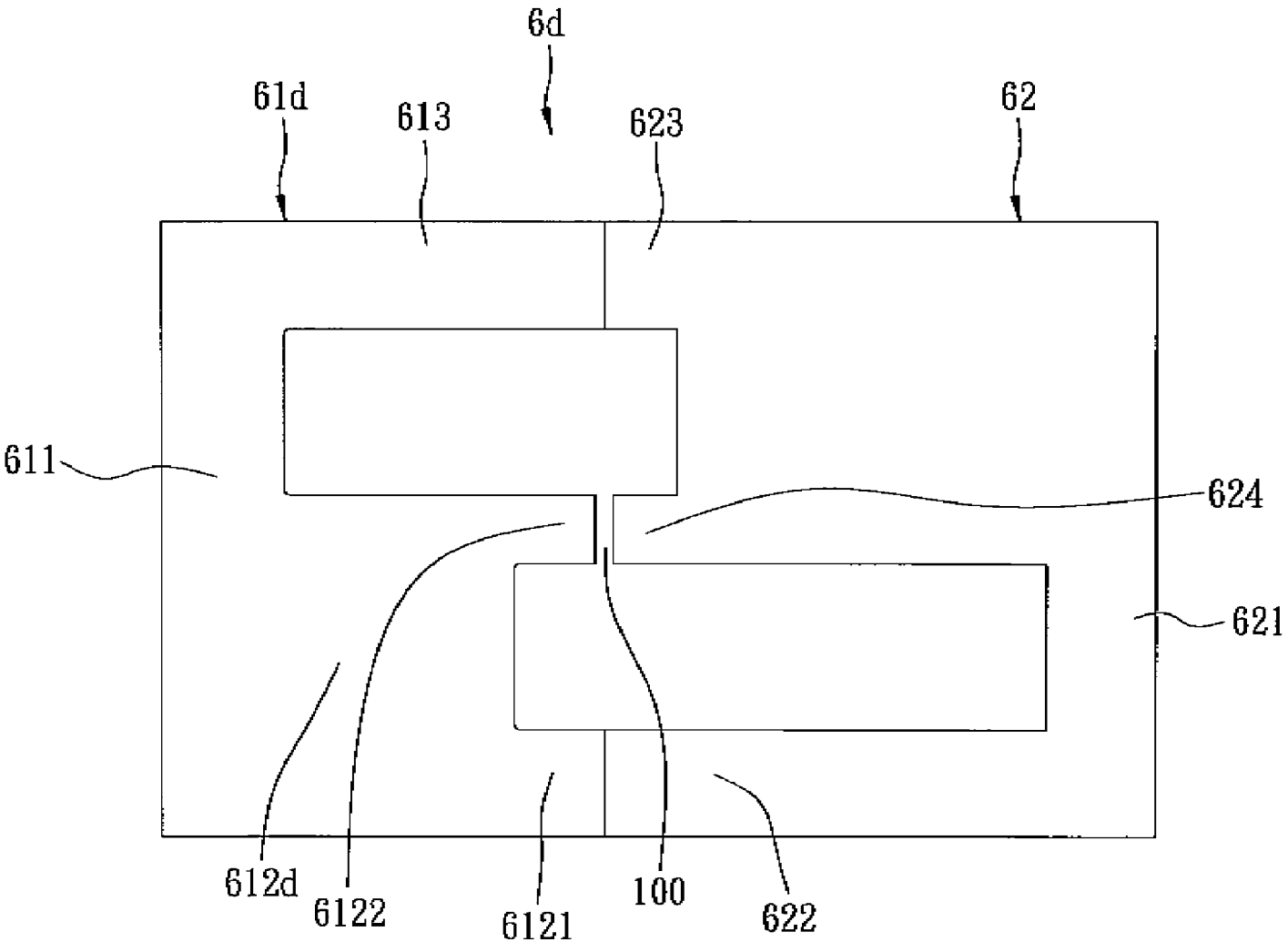
FIG. 17 is a schematic view showing a core unit of the fifth preferred embodiment.

FIGS. 15 to 17 illustrate the fifth preferred embodiment of a transformer according to this invention, which is a modification of the first preferred embodiment.

In this embodiment, for the first core part (61*d*) of the core unit (6*d*), the first insertion segment (612*d*) has first and second projections 6121, 6122 opposite to each other in the longitudinal direction (X) so that the second projection 6122 is disposed between the first extension segment 613 and the first projection 6121. The first projection 6121 extends into the first secondary winding portion 22 of the bobbin unit 2, and is disposed in contact with the first insertion segment 622 of the second core part 62 (see FIG. 17). The second projection 6122 extends outwardly of the first primary winding portion 21 of said bobbin unit 2 (see FIG. 15), is registered with the first adjusting segment 624 of the second core part 62 such that the first air gap 100 is formed between the second projection 6122 and the first adjusting segment 624 of the second core part 62.

Furthermore, the bobbin unit 2 further has two pins 221 that extend from one side of the secondary winding portion 22, and a wire-guiding piece 211 disposed on a connecting side of the first primary winding portion 21 that is connected to the first secondary winding portion 22, and spaced apart from the first secondary winding portion 22. When forming the first secondary winding 4, first, one end of a winding wire is coupled to one pin 221. Then, the winding wire is wounded continuously around the first secondary winding portion 22 of the bobbin unit 2, and subsequently, is guided by the wire-guiding piece 211 to the other pin 221. Finally, the other end of the winding wire is coupled to the other pin 221. Thus, such winding can avoid high voltage discharge.

Figure 18:
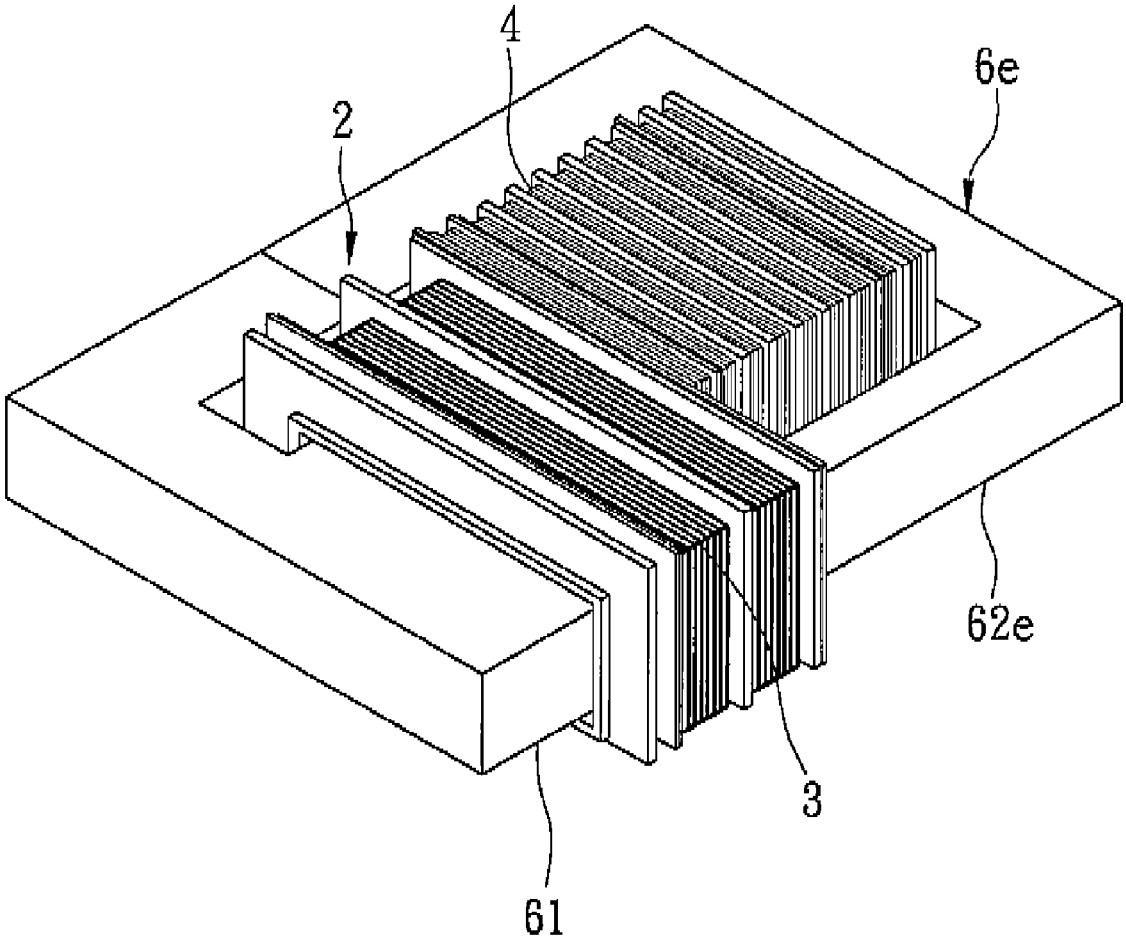
FIG. 18 is a perspective view showing the sixth preferred embodiment of a transformer according to the present invention.
Figure 19:
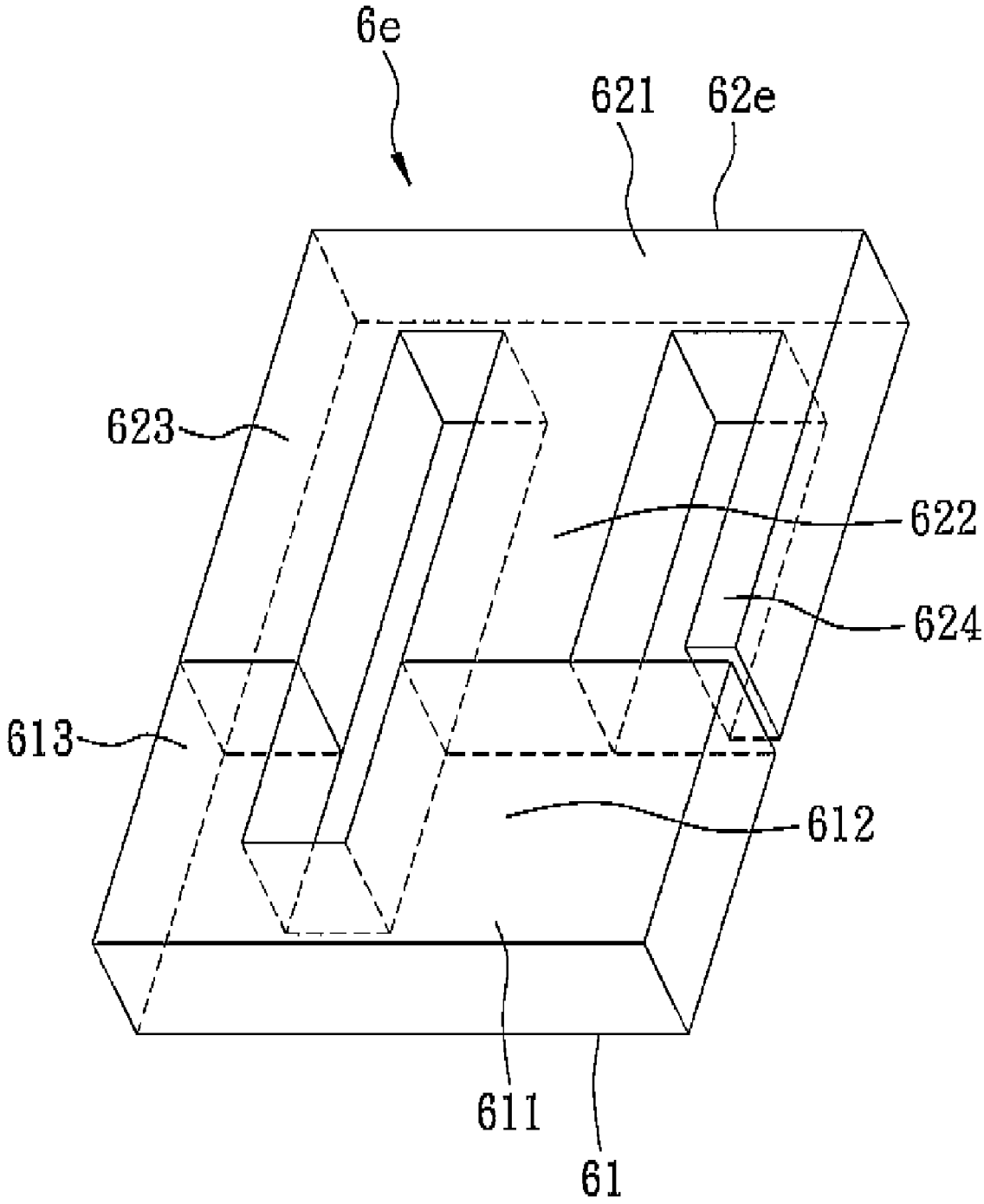
FIG. 19 is a perspective view showing a core unit of the sixth preferred embodiment.
Figure 20:
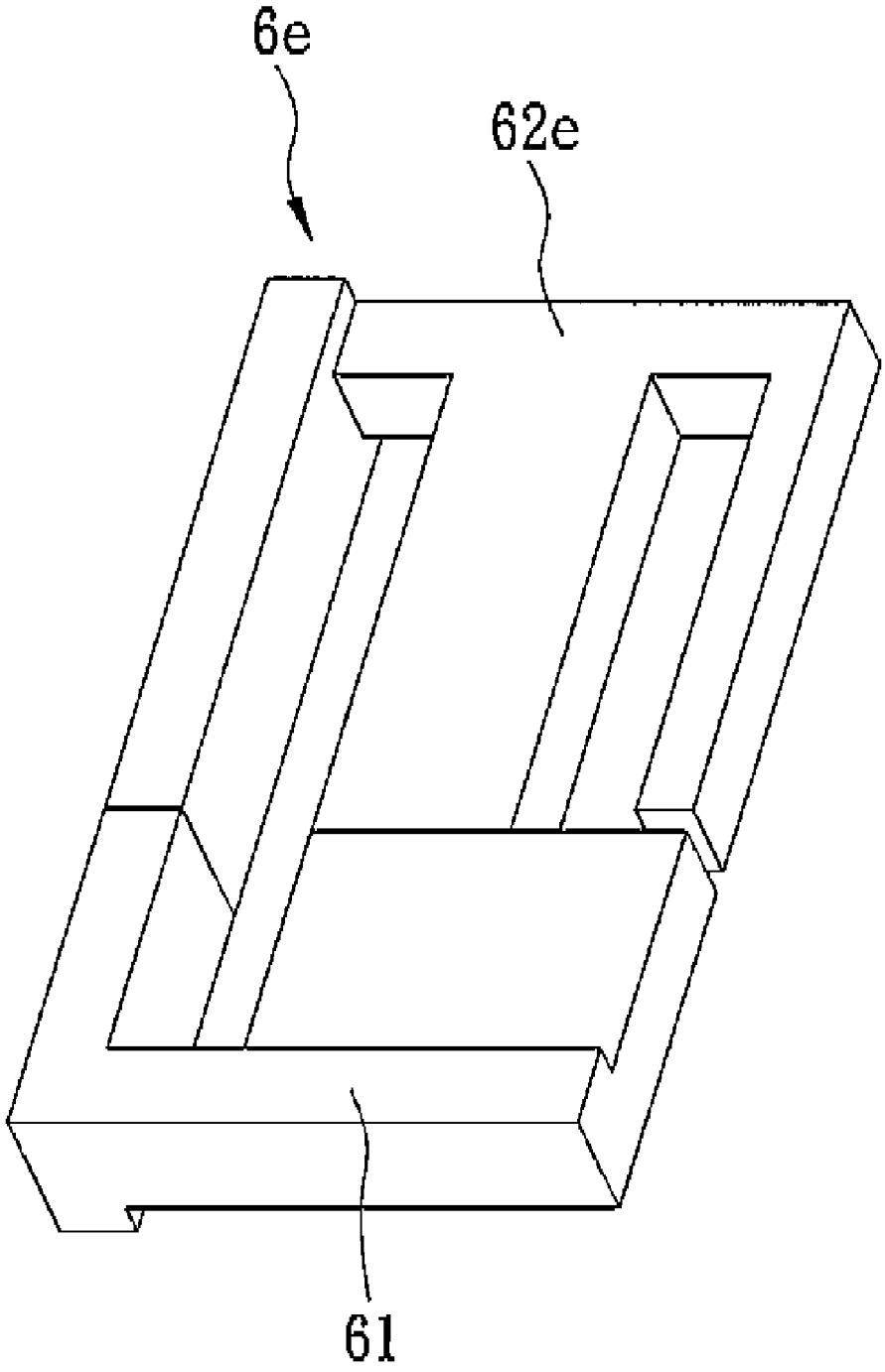
FIG. 20 is a perspective view of a variation of the core unit of the sixth preferred embodiment.

FIGS. 18 and 19 illustrate the sixth preferred embodiment of a transformer according to this invention, which is a modification of the first preferred embodiment. Unlike the first preferred embodiment, for the second core part (62*e*) of the core unit (6*e*), the first insertion segment 622 is disposed spacedly between the first extension segment 623 and the first adjusting segment 624. FIG. 20 illustrates a variation of the transformer of the sixth preferred embodiment.

Figure 21:
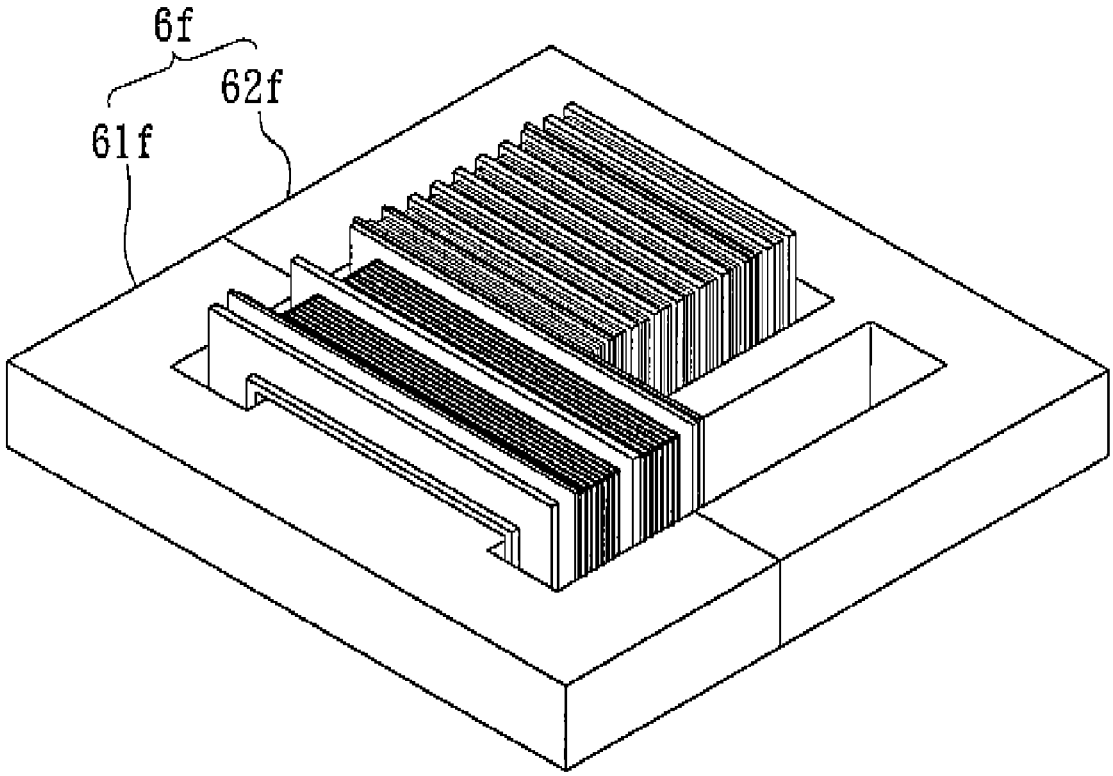
FIG. 21 is a perspective view showing the seventh preferred embodiment of a transformer according to the present invention.
Figure 22:
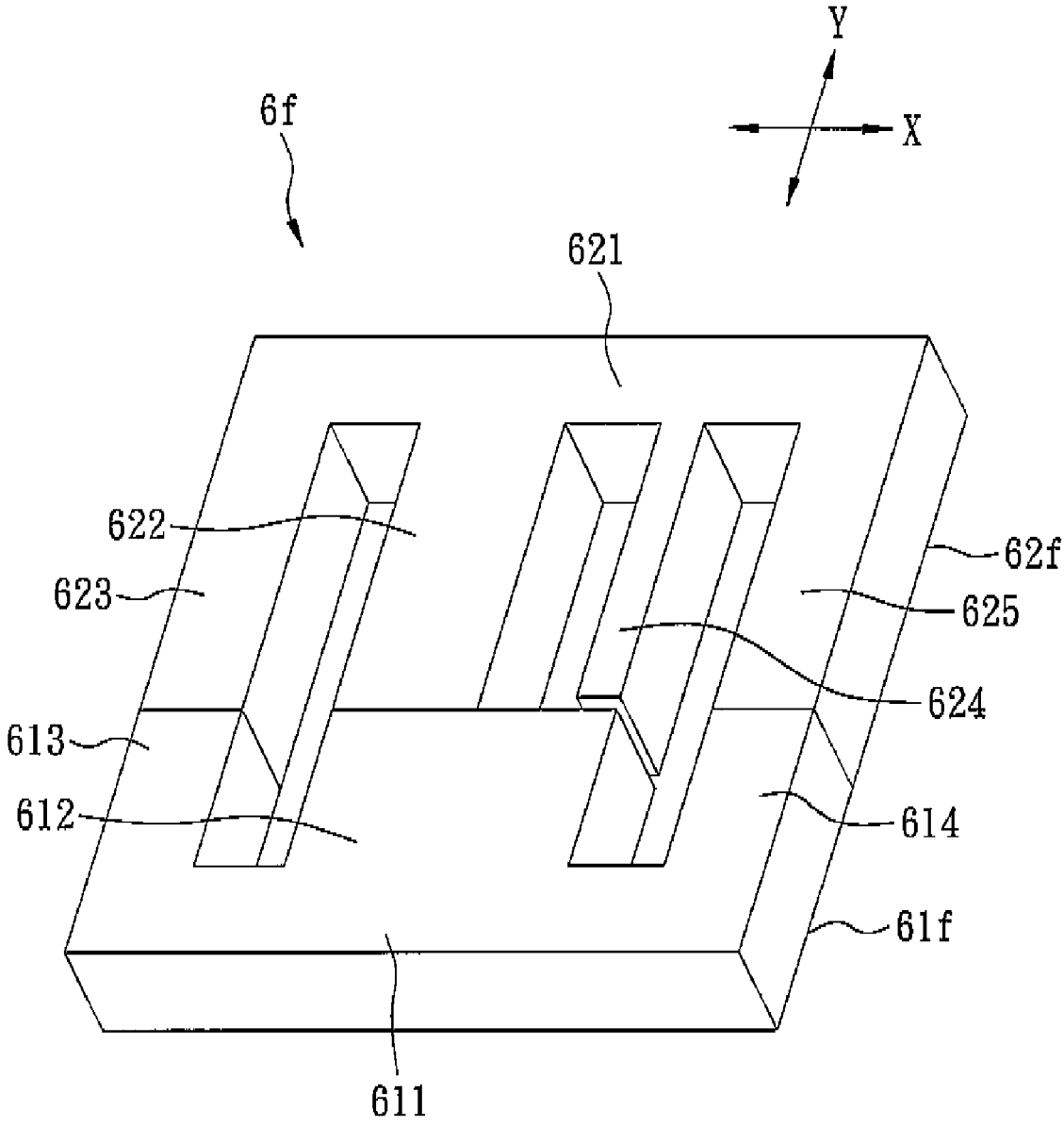
FIG. 22 is a perspective view showing a core unit of the seventh preferred embodiment.

FIGS. 21 and 22 illustrate the seventh preferred embodiment of a transformer according to this invention, which is a modification of the sixth preferred embodiment. In this embodiment, the first core part (61*f*) of the core unit (6*f*) further includes a second extension segment 614 extending from the connecting segment 611 in the transverse direction (Y), and opposite to the first extension segment 613 in the longitudinal direction (X) so that the first insertion segment 612 is disposed spacedly between the first and second extension segments 613, 614.

The second core part (62*f*) of the core unit (6*f*) further includes a second extension segment 625 extending from the connecting segment 621 in the transverse direction (Y) toward the first core part (61*f*), opposite to the first extension segment 623 in the longitudinal direction (X) so that the first insertion segment 622 and the first adjusting segment 624 are disposed spacedly between the first and second extension segments 623, 625, and disposed in contact with the second extension segment 614 of the first core part (61*f*).

Figure 23:
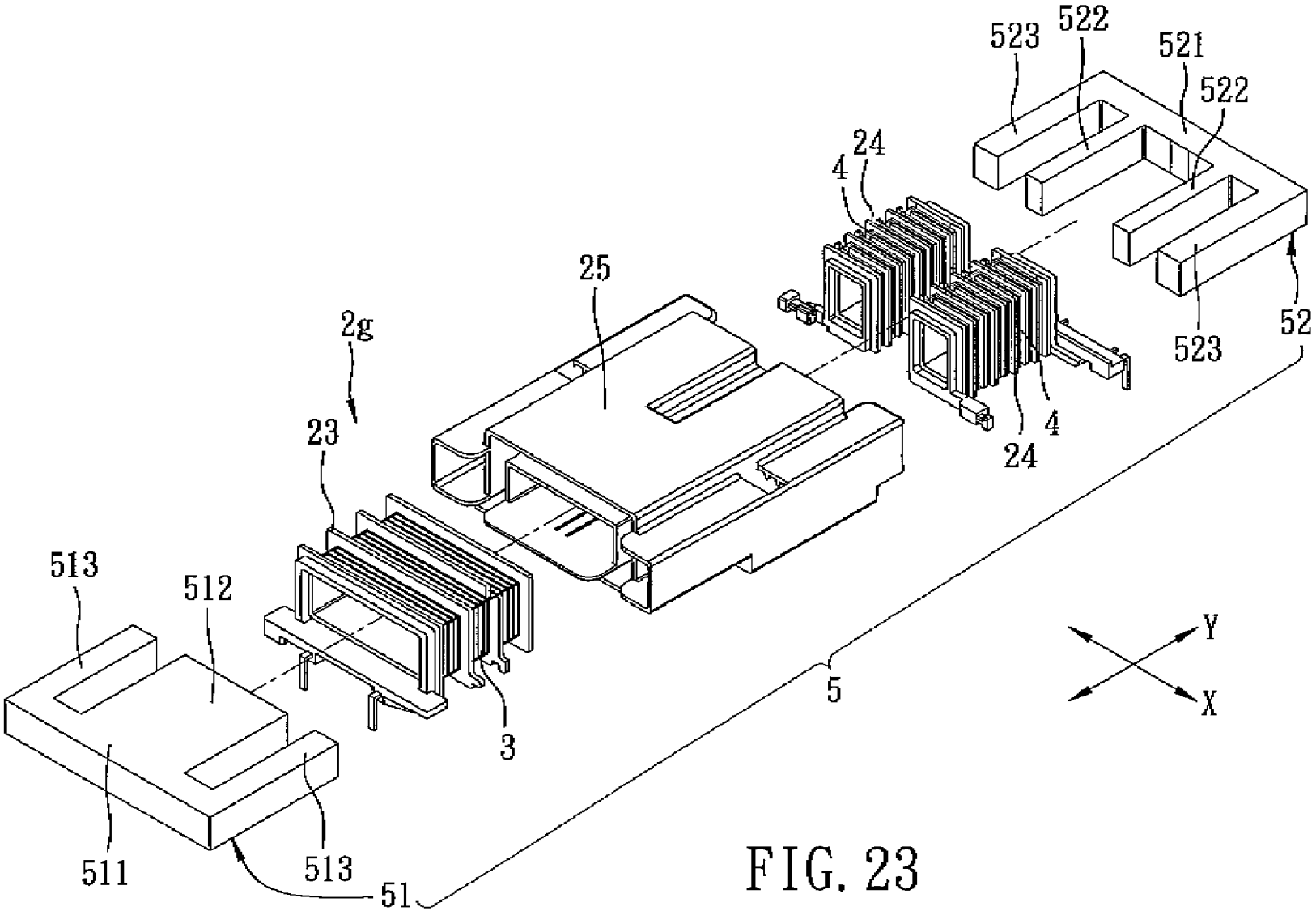
FIG. 23 is an exploded perspective view showing the eighth preferred embodiment of a transformer according to the present invention.

Referring to FIG. 23, the eighth preferred embodiment of a transformer according to the present invention is shown to include a bobbin unit (2*g*), a primary winding 3, two secondary windings 4, and a core unit 5.

The bobbin unit (2*g*) includes a primary winding portion 23, two secondary winding portions 24, and a casing 25 for mounting the primary winding portion 23 and the secondary winding portions 24 therein.

The primary winding 3 is wound around the primary winding portion 23 of the bobbin unit (2*g*).

The secondary windings 4 are wound respectively around the secondary winding portions 24 of the bobbin unit (2*g*), and are coupled electromagnetically to the primary winding 3.

The core unit 5 is mounted to the bobbin unit (2*g*) and includes a first core part 51, and a second core part 52 that forms a magnetic circuit path with the first core part 51.

The first core part 51 includes a connecting segment 511, two extension segments 513, and an insertion segment 512. The connecting segment 511 extends in is a longitudinal direction (X). The extension segments 513 are opposite to each other in the longitudinal direction (X), and extend from the connecting segment 511 in a transverse direction (Y) that is perpendicular to the longitudinal direction (X) into the casing 25. The insertion segment 512 is disposed spacedly between the extension segments 513, and extends from the connecting segment 511 in the transverse direction (Y) through the primary winding portion 23 of the bobbin unit (2*g*).

The second core part 52 includes a connecting segment 521, two extension segments 523, and two insertion segments 522. The connecting segment 521 extends in the longitudinal direction (X) The extension segments 523 are opposite to each other in the longitudinal direction (X), and extend from the connecting segment 521 in the transverse direction (Y) into the casing 25 such that the extension segments 523 of the second core part 52 contact respectively the extension segments 513 of the first core part 51. The insertion segments 522 are disposed spacedly between the extension segments 523, and extend respectively from the connecting segment 521 in the transverse direction (Y) through the secondary winding portions 24 of the bobbin unit (2*g*) such that the insertion segments 522 of the second core part 52 contact respectively the insertion segments 512 of the first core part 51.

It should be noted that, in this embodiment, a load coupled to the transformer, and a resonant frequency can be appropriately selected to attain maximum power transfer without any adjusting segment in the previous preferred embodiments. Furthermore, in other embodiments, the insertion segment 512 of the first core part 51 can be grinded to adjust leakage magnetic flux.

In sum, during fabrication, the width of the first and second air gaps 100, 200 can be adjusted by varying the lengths of the first and second adjusting segments 624, 627 so as to control magnetic leakage from the magnetic circuit path, thereby attaining impedance match. Therefore, the transformer of the present invention can attain maximum power transfer.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A transformer comprising:

a bobbin unit having a first primary winding portion, and a first secondary winding portion;

a first primary winding wound around said first primary winding portion of said bobbin unit;

a first secondary winding wound around said first secondary winding portion of said bobbin unit, and coupled electromagnetically to said first primary winding; and a core unit mounted to said bobbin unit and including a first core part that includes a connecting segment extending in a longitudinal direction, a first insertion segment extending from said connecting segment of said first core part in a transverse direction perpendicular to the longitudinal direction and through said first primary winding portion of said bobbin unit, and a first extension segment extending from said connecting segment of said first core part in the transverse direction and spaced apart from said first insertion segment of said first core part, and a second core part that forms a magnetic circuit path with said first core part and that includes a connecting segment extending in the longitudinal direction, a first insertion segment extending from said connection segment of said second core part in the transverse direction toward said first core part and through said first secondary winding portion of said bobbin unit, and disposed in contact with said first insertion segment of said first core part, a first extension segment extending from said connection segment of said second core part in the transverse direction toward said first core part, spaced apart from said first insertion segment of said second core part, and disposed in contact with said first extension segment of said first core part, and a first adjusting segment extending from said connecting segment of said second core part in the transverse direction toward said first core part.

2. The transformer as claimed in claim 1, wherein a first air gap is formed between said first insertion segment of said first core part and said first adjusting segment of said second core part.

3. The transformer as claimed in claim 2, wherein said first adjusting segment of said second core part is disposed between said first insertion segment and said extension segment of said second core part.

4. The transformer as claimed in claim 3, wherein said first adjusting segment of said second core part is integrally connected to said first extension segment of said second core part.

5. The transformer as claimed in claim 3, further comprising a second secondary winding coupled electromagnetically to said first primary winding, wherein:

said bobbin unit further has a second secondary winding portion opposite to said first secondary winding portion in the longitudinal direction for winding said second secondary winding therearound;

said first core part of said core unit further includes a second extension segment extending from said connecting segment of said first core part in the transverse direction, and opposite to said first extension segment of said first core part in the longitudinal direction so that said first insertion segment of said first core part is disposed spacedly between said first and second extension segments of said first core part; and said second core part of said core unit further includes a second extension segment extending from said connecting segment of said second core part in the transverse direction toward said first core part, opposite to said first extension segment of said second core part in the longitudinal direction so that said first insertion segment and said first adjusting segment of said second core part are disposed spacedly between said first and second extension segments of said second core part, and disposed in contact with said second extension segment of said first core part, and a second insertion segment disposed between said first extension segment and said first adjusting segment of said second core part, and extending from said connecting segment of said second core part in the transverse direction toward said first core part and through said second secondary winding portion of said bobbin unit so as to contact said first insertion segment of said first core part.

6. The transformer as claimed in claim 5, wherein said bobbin unit includes:

a first bobbin having first and second winding end portions opposite to each other in the transverse direction, said second winding end portion of said first bobbin serving as said first secondary winding portion; and a second bobbin having first and second winding end portions opposite to each other in the transverse direction, said second winding end portion of said second bobbin being connected to said second winding end portion of said first bobbin and serving as said second secondary winding portion, said first winding end portions of said first and second bobbins being complementary and connected to each other, and constituting said first primary winding portion.

7. The transformer as claimed in claim 6, wherein:

each of said first and second bobbins of said bobbin unit further has first and second pins extending from said first winding end portion thereof, and a third pin extending from said second winding end portion thereof;

said first primary winding is formed through continuous winding of a winding wire that has opposite end portions coupled respectively to first pins of said first and second bobbins;

said first secondary winding is formed through continuous winding of a winding wire that has opposite end portions, one of which extends along said first winding end portion of said first bobbin of said bobbin unit and is coupled to said second pin of said first bobbin of said bobbin unit, and the other one of which is coupled to said third pin of said first bobbin of said bobbin unit; and said second secondary winding is formed through continuous winding of a winding wire that has opposite end portions, one of which extends along said first winding end portion of said second bobbin of said bobbin unit and is coupled to said second pin of said second bobbin of said bobbin unit, and the other one of which is coupled to said third pin of said second bobbin of said bobbin unit.

8. The transformer as claimed in claim 7, wherein said first winding end portion of each of said first and second bobbins of said bobbin unit is formed with a wire-receiving passage for permitting extension of said one of said opposite end portions of said winding wire of a corresponding one of said first and second secondary windings therethrough.

9. The transformer as claimed in claim 7, wherein one of said first and second bobbins is formed with an engaging groove, and the other one of said first and second bobbins has an engaging flange engaging said engaging groove.

10. The transformer as claimed in claim 7, wherein said first primary winding portion of said bobbin unit has a connecting side connected to said first and second secondary winding portions, and formed with an opening that is disposed between said first and second secondary winding portion and that is registered with said first adjusting segment of said second core part, thereby permitting passing of magnetic field lines therethrough.

11. The transformer as claimed in claim 3, further comprising a second primary winding, and a second secondary winding coupled electromagnetically to said second primary winding, wherein:

said bobbin unit includes first and second bobbins opposite to each other in the longitudinal direction, each of said first and second bobbins having first and second winding end portions opposite to each other in the transverse direction, said first and second winding end portions of said first bobbin serving respectively as the first primary winding portion and the first secondary winding portion, said first and second winding end portions of said second bobbin serving respectively as a second primary winding portion for winding said second primary winding therearound, and a second secondary winding portion for winding said second secondary winding therearound, wherein:

said first core part of said core unit further includes a second insertion segment extending from said connecting segment of said first core part in the transverse direction through said second primary winding portion of said bobbin unit, and opposite to said first insertion segment of said first core part in the longitudinal direction so that said first extension segment of said first core part is disposed spacedly between said first and second insertion segments of said first core part; and said second core part of said core unit further includes a second insertion segment extending from said connecting segment of said second core part in the transverse direction toward said first core part and through said second secondary winding portion of said bobbin unit, opposite to said first insertion segment of said second core part in the longitudinal direction so that said first extension segment of said second core part is disposed spacedly between said first and second insertion segments of said second core part, and disposed in contact with said second insertion segment of said first core part, and a second adjusting segment disposed between said second insertion segment and said first extension segment of said second core part, and extending from said connecting segment of said second core part in the transverse direction toward said first core part such that a second air gap is formed between said second insertion segment of said first core part and said second adjusting segment of said second core part.

12. The transformer as claimed in claim 11, wherein said first extension segment of said second core part is integrally connected with said first and second adjusting segments of said second core part.

13. The transformer as claimed in claim 3, wherein said first insertion segment of said first core part has first and second projections opposite to each other in the longitudinal direction so that said second projection is disposed between said first extension segment and said first projection, said first projection extending into said first secondary winding portion of said bobbin unit, and being disposed in contact with said first insertion segment of said second core part, said second projection extending outwardly of said first primary winding portion of said bobbin unit, and being registered with said first adjusting segment of said second core part such that said first air gap is formed between said second projection and said first adjusting segment of said second core part.

14. The transformer as claimed in claim 2, wherein said first insertion segment of said second core part is disposed spacedly between said first extension segment and said first adjusting segment of said second core part.

15. The transformer as claimed in claim 14, wherein:

said first core part of said core unit further includes a second extension segment extending from said connecting segment of said first core part in the transverse direction, and opposite to said first extension segment of said first core part in the longitudinal direction so that said first insertion segment of said first core part is disposed spacedly between said first and second extension segments of said first core part; and said second core part of said core unit further includes a second extension segment extending from said connecting segment of said second core part in the transverse direction toward said first core part, opposite to said first extension segment of said second core part in the longitudinal direction so that said first insertion segment and said first adjusting segment of said second core part are disposed spacedly between said first and second extension segments of said second core part, and disposed in contact with said second extension segment of said first core part.

16. The transformer as claimed in claim 1, wherein said adjusting segment of said second core part of said core unit has an end surface that faces said first core part of said core unit and that serves as a magnetic leakage area.

17. A transformer comprising:

a bobbin unit including a primary winding portion, two secondary winding portions, and a casing for mounting said primary winding portion and said secondary winding portions therein;

a primary winding wound around said primary winding portion of said bobbin unit;

two secondary windings wound respectively around said secondary winding portions of said bobbin unit, and coupled electromagnetically to said primary winding; and a core unit mounted to said bobbin unit, and including a first core part that includes a connecting segment that extends in a longitudinal direction, two extension segments opposite to each other in the longitudinal direction, and extending from said connecting segment of said first core part in a transverse direction that is perpendicular to the longitudinal direction into said casing, and an insertion segment disposed spacedly between said extension segments of said first core part, and extending from said connecting segment in the transverse direction through said primary winding portion of said bobbin unit, and a second core part that forms a magnetic circuit path with said first core part and that includes a connecting segment extending in the longitudinal direction, two extension segments opposite to each other in the longitudinal direction, and extending from said connecting segment of said second core part in the transverse direction into said casing such that said extension segments of said second core part contact respectively said extension segments of said first core part, and two insertion segments disposed spacedly between said extension segments of said second core part, and extending respectively from said connecting segment of said second core part in the transverse direction through said secondary winding portions of said bobbin unit such that said insertion segments of said second core part contact respectively said insertion segments of said first core part.

* * * * *